US006292777B1

(12) United States Patent
Inoue et al.

(10) Patent No.: US 6,292,777 B1
(45) Date of Patent: Sep. 18, 2001

(54) PHASE QUANTIZATION METHOD AND APPARATUS

(75) Inventors: Akira Inoue, Tokyo; Masayuki Nishiguchi, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/239,515

(22) Filed: Jan. 29, 1999

(30) Foreign Application Priority Data

Feb. 6, 1998 (JP) ..... 10-041095

(51) Int. Cl.[7] ..... G10L 19/00

(52) U.S. Cl. ..... 704/230; 704/207; 704/219; 704/220; 704/229

(58) Field of Search ..... 704/207, 230, 704/219, 220, 223, 229, 205, 208, 221, 222

(56) References Cited

U.S. PATENT DOCUMENTS

| | | | | |
|---|---|---|---|---|
| 4,850,022 | * | 7/1989 | Honda et al. | 704/207 |
| 4,964,166 | * | 10/1990 | Wilson | 704/229 |
| 5,054,072 | * | 10/1991 | McAulay et al. | 704/207 |
| 5,091,945 | * | 2/1992 | Kleijn | 704/219 |
| 5,199,078 | * | 3/1993 | Orglmeister | 704/230 |
| 5,630,011 | * | 5/1997 | Lim et al. | 704/205 |
| 5,706,392 | * | 1/1998 | Goldberg et al. | 704/200.1 |
| 5,809,459 | * | 9/1998 | Bergstrom et al. | 704/223 |
| 5,848,387 | * | 12/1998 | Nishiguchi et al. | 704/214 |
| 5,983,173 | * | 11/1999 | Inoue et al. | 704/219 |
| 6,052,658 | * | 4/2000 | Wang et al. | 704/205 |
| 6,094,629 | * | 7/2000 | Grabb et al. | 704/219 |
| 6,115,685 | * | 9/2000 | Inoue et al. | 704/205 |

OTHER PUBLICATIONS

Marques et al., "Harmonic Coding at 4.8 kb/s" ICASSP–90., International conference on Acoustics, Speech, and Signal Processing, 1990, vol. 1 pp. 17–20).*

Gottesman et al., ("Enhanced Waveform Interpolative coding at 4 kbps", Speech Coding Proceedings, 1999 IEEE Workshop, Jun. 20–23 1999, pp. 90–92).*

Kim et al., ("On the Perceptual Weighting Function for Phase Quantization of Speech" 2000 IEEE Workshop on Speech Coding 2000 Proceedings, Sep. 17–20, 2000).*

* cited by examiner

*Primary Examiner*—William Korzuch
*Assistant Examiner*—Vijay B Chawan
(74) *Attorney, Agent, or Firm*—Jay H. Maioli

(57) ABSTRACT

A phase quantization method and apparatus in which the phase information of the input signal such as at the time of the sinusoidal synthesis encoding can be quantized efficiently. The phase of the input signal derived from speech signals from an input terminal 11 is found by a phase detection unit 12 and scalar-quantized by a scalar quantizer 13. The spectral amplitude weighting k of each harmonics is calculated by a weighting calculation unit 18 based on the LPC coefficients from a terminal 17. Using the weighting k, a bit allocation calculation unit 19 calculates an optimum number of quantization bits of respective harmonics to send the calculated optimum number to the scalar quantizer 13.

20 Claims, 28 Drawing Sheets

PHASE QUANTIZATION METHOD AND APPARATUS

BACKGROUND OF THE INVENTION

1. Field of the Invention

This invention relates to a method and apparatus for detecting and quantizing the phase of high harmonics components in sine wave synthesis encoding.

2. Description of the Related Art

There are known a variety of encoding methods for audio signals (inclusive of speech and acoustic signals) in which the signals are compressed by exploiting statistic properties in the time domain and in the frequency domain of the audio signals and psychoacoustic characteristics of the human being. These encoding methods may be roughly classified into time-domain encoding, frequency domain encoding and analysis-synthesis encoding.

Examples of the high efficiency encoding of speech signals etc include sinusoidal coding, such as harmonic encoding, multi-band excitation (MBE) encoding, sub-band coding, linear predictive coding (LPC), discrete cosine transform (DCT) encoding, modified DCT (MDCT) encoding and fast Fourier transform (FET).

Meanwhile, in high efficiency speech coding, employing the above-mentioned MBE encoding, harmonics encoding or sinusoidal transform coding (STC) for input speech signals, or employing the sinusoidal coding for linear prediction coding residuals (LPC residuals) of input speech signals, the information concerning the amplitude or the spectral envelope of respective sine waves (harmonics) as elements of analysis/synthesis is transmitted. However, the phase is not transmitted and simply the phase is calculated suitably at the time of synthesis.

Thus, a problem is raised that the speech waveform, reproduced on decoding, differs from the waveform of the original input speech waveform. That is, for realizing the replica of the original speech signal waveform, it is necessary to detect the phase information of the respective harmonics components frame-by-frame and to quantize the information with high efficiency to transmit the resulting quantized signals.

SUMMARY OF THE INVENTION

It is therefore an object of the present invention to provide a phase quantization method and apparatus whereby it is possible to produce the replica of the original waveform.

With the phase quantization method and device according to the present invention, the phase of respective harmonics of signals derived from the input speech signals is quantized depending on the number of assigned bits as found by calculations to quantize the phase information of the input signal waveform derived from the speech signals efficiently.

The input signal waveform may be the speech signal waveform itself or the signal waveform of short-term prediction residuals of the speech signals.

Also, with the phase quantization method and device according to the present invention, the optimum number of assigned quantization bits of the respective harmonics is calculated from the spectral amplitude characteristics of the input speech signals and the phase of the harmonics components of the input speech signals and short-term prediction residual signals of the input speech signal is scalar-quantized, under separation of fixed delay components if so required, in order to effect phase quantization efficiently.

With the phase quantization method and device according to the present invention, the phase of the respective harmonics components of signals derived from the input speech signals is quantized responsive to the number of assigned bits as found by calculations in order to effect phase quantization efficiently.

By the above configuration, the decoding side is able to detect the phase information of the original waveform to improve the waveform reproducibility. In particular, if the present method and device are applied to speech encoding for sinusoidal synthesis encoding, waveform reproducibility can be improved to prohibit the non-spontaneous synthesized speech.

DESCRIPTION OF THE PREFERRED EMBODIMENTS

Figure 1:
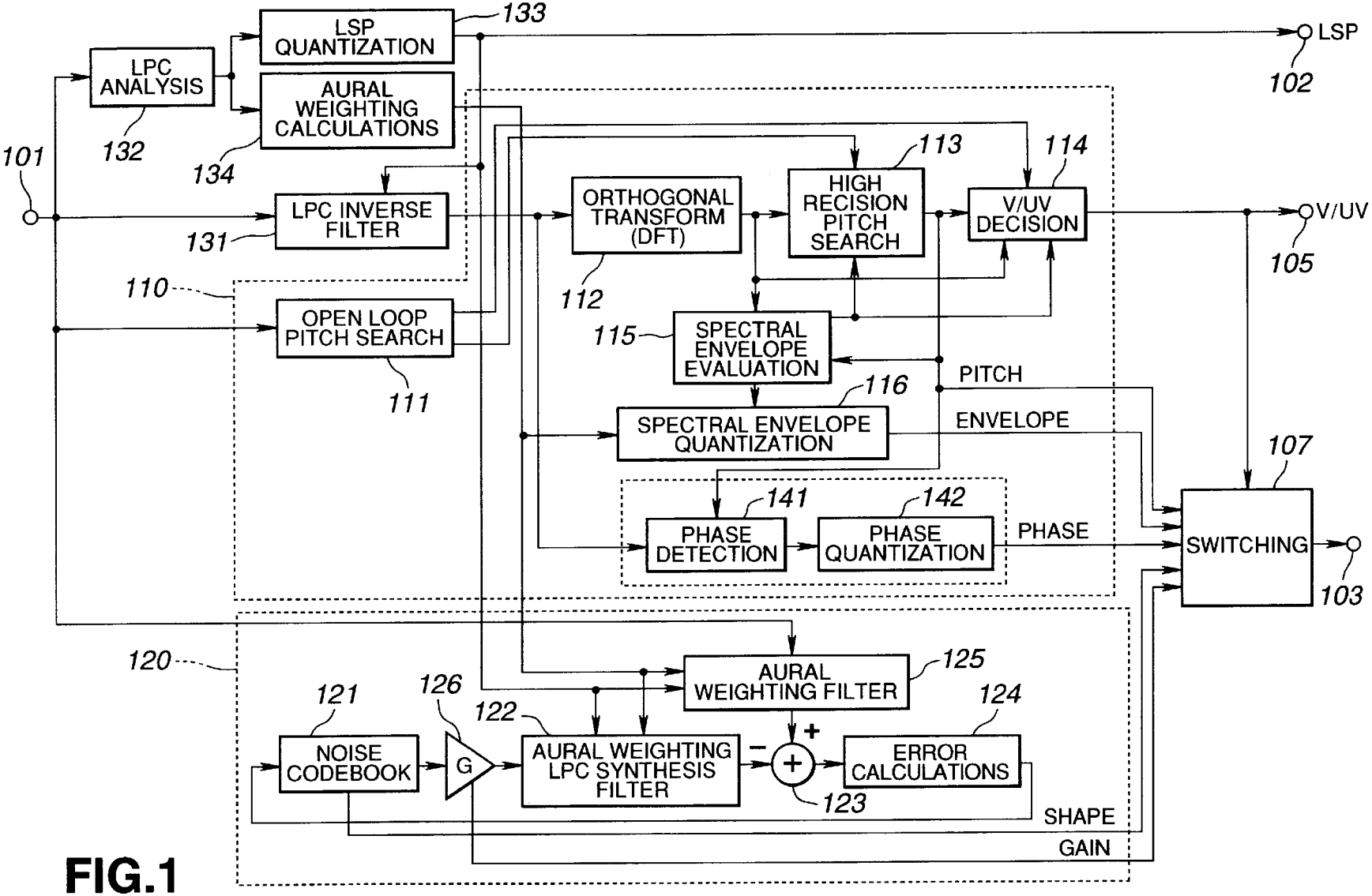
FIG. 1 is a schematic block diagram showing an example of a speech encoding apparatus to which can be applied an embodiment of the phase detection method and apparatus according to the present invention.

Referring to the drawings, preferred embodiments of the present invention will be explained in detail.

The phase quantization method and apparatus according to the present invention is applied to sinusoidal coding, such as multi-band encoding (MBE), sinusoidal transform coding (STC) or harmonic coding, or to an encoding system employing the sinusoidal coding to the linear predictive coding (LPC) residuals.

Prior to explanation of the embodiment of the present invention, a speech encoding apparatus for doing sine wave analysis encoding, as a device to which the phase quantization device or the phase quantization method according to the present invention is applied, is explained.

FIG. 1 schematically shows an example of a speech encoding apparatus to which is applied the phase quantization device or the phase quantization method.

The speech signal encoding apparatus of FIG. 1 includes a first encoding unit 110 for doing sinusoidal analysis coding, such as harmonic coding, on the input signals, and a second encoding unit 120 for doing code excited linear coding (CELP), employing vector quantization by closed loop search of the optimum vector, on the input signals, using, for example, an analysis-by-synthesis method. The speech signal encoding apparatus uses the first encoding unit 110 for encoding the voiced portion (V portion) of the input signals, while using the second encoding unit 120 for encoding the unvoiced portion (UV portion) of the input signals. An embodiment of the phase quantization according to the present invention is applied to the first encoding unit 110. In the embodiment of FIG. 1, short-term prediction errors of the input speech signals, such as linear prediction encoding (LPC) residuals, are found, and subsequently sent to the first encoding unit 110.

In FIG. 1, speech signals sent to an input terminal 101 are sent to an LPC inverted filter 131 and a LPC analysis unit 132, while being sent to an open-loop pitch search unit 111 of the first encoding unit 110. The LPC analysis unit 132 multiplies the speech signals with a hamming window, with a length of the input speech waveform corresponding to 256 samples or thereabouts as a block, to find a linear prediction coefficient, that is a so-called α-parameter, by a self-correlation method. The framing interval, as a data output unit, is set to 160 samples or thereabouts. If the sampling frequency of the input speech signal fs is 8 kHz, as an example, the frame interval is 160 samples or 20 msec.

The α-parameters from the LPC analysis unit 132 are converted by, for example, α-to-LSP conversion into linear spectral pair (LSP) parameters. That is, the α-parameters, found as the direct type filter coefficients, are converted into, for example, ten, that is five pairs of, LSP parameters. This conversion is done by, for example, the newton-Rhapson method. The reason of conversion to the LSP parameters is that the LSP parameters are better in interpolation characteristics than the α-parameters. The LSP parameters are processed by a LSP quantizer 133 with matrix or vector quantization. At this time, the inter-frame difference may be taken first prior to vector quantization, or plural frames can be collected together to perform matrix quantization. Here, 20 msec is set as a frame and the LSP parameters, calculated every 20 msec, are processed with matrix or vector quantization.

A quantized output of the LSP quantizer 133, that is the indices for LSP quantization, are taken out via terminal 102, while the quantized LSP vectors are processed by, for example, LSP interpolation or LSP-to-α conversion into α-parameters for LPC which are then sent to a perceptually weighted LPC synthesis filter 122 and to a perceptually weighted filter 125.

The α-parameters from the LPC analysis unit 132 are sent to a perceptually weighted filter calculation unit 134 to find data for perceptually weighting. These weighting data are sent to the perceptually weighted LPC synthesis filter 122 and the perceptually weighted filter 125 of the second encoding unit 120.

The LPC inverted filter 131 performs inverted filtering of taking out linear prediction residuals (LPC residuals) of the input speech signals, using the above-mentioned α-parameters. An output of the LPC inverted filter 131 is sent to an orthogonal transform unit 112 and a phase detection unit 140 of, for example, a discrete cosine transform (DCT) circuit of the first encoding unit 110 performing the sine wave analysis encoding, for example, the harmonic encoding.

The α-parameters from the LPC analysis unit 132 are sent to the perceptually weighted filter calculation unit 134 to find data for perceptually weighting. These data for perceptually weighting are sent to a perceptually weighted vector quantizer 116 as later explained, the perceptually weighted LPC synthesis filter 122 of the second encoding unit 120 and to the perceptually weighted filter 125.

The α-parameters from the LPC analysis unit 132 are sent to the perceptually weighted filter calculation unit 134 to find data for perceptual weighting. These weighting data are sent to the perceptually weighted LPC synthesis filter 122 and the perceptually weighted filter 125 of the second encoding unit 120.

The LPC inverted filter 131 performs inverted filtering of taking out the linear prediction (LPC) residuals of input speech signals. An output of the LPC inverted filter 131 is sent to the orthogonal transform unit 112, such as a discrete cosine transform (DFT) circuit, and the phase detection unit 140, of the first encoding unit 110 doing, for example, harmonic encoding.

The open-loop pitch search unit 111 of the first encoding unit 110 is fed with input speech signals from the input terminal 101. The open-loop pitch search unit 111 takes LPC residuals of the input signal to perform rough pitch search by the open loop. The rough pitch data, thus extracted, are sent to a high-precision pitch search unit 113 where high-precision pitch search (fine pitch search) is carried out by a closed loop operation as later explained. From the open-loop pitch search unit 111, a maxinum value of the normalized auto-correlation r(p), obtained on normalizing the maximum value of auto-correlation of the LPC residuals with the power, are taken out along with the rough pitch data, and sent to a voiced/unvoiced (U/UV) discriminating unit 114.

The high-precision pitch search unit 113 is fed with rough pitch data, extracted by the open-loop pitch search unit 111, and frequency domain data, obtained on, for example, DFT. The high-precision pitch search unit 113 swings the data by ±several samples, at an interval of 0.2 to 0.5, about the rough pitch data as center, to approach to optimum sub-decimal fine pitch data value. As the fine search technique, the so-called analysis-by-synthesis method is used, and the pitch value is selected so that the synthesized power spectrum will be closest to the power spectrum of the original speech. The pitch data from the high-precision pitch search unit 146 by the closed search loop are sent to a spectral envelope evaluation unit 115, a phase detection unit 141 and to a switching unit 107.

The spectral envelope evaluation unit 115 evaluates a spectral envelope, as the magnitudes of the respective harmonics and the set thereof, based on the spectral amplitude and the pitch as the orthogonal transform output of the LPC residuals, to send the result to the high-precision pitch search unit 113, V/UV discriminating unit 114 and to a spectral envelope quantization unit 116 (perceptually weighted vector quantizer).

The V/UV discriminating unit 114 performs V/UV discrimination of a frame in question based on an output of the orthogonal transform unit 112, an optimum pitch from the high-precision pitch search unit 113, spectral amplitude data from the spectral envelope evaluation unit 115 and on the maximum value of the normalized auto-correlation r(p) from the open-loop pitch search unit 111. The boundary position of the band-based results of V/UV discrimination in case of MBE may also be used as a condition for V/UV discrimination. A discrimination output of the V/UV discrimination unit 115 is outputted via an output terminal 105.

An output of the spectral envelope evaluation unit 115 or the input of the spectral envelope quantization unit 116 is provided with a data number conversion unit which is a sort of the sampling rate conversion unit. The function of this data number conversion unit is to provide a constant number of envelope amplitude data |Am| in consideration that the number of division of the frequency bands on the frequency axis differs in dependence upon the pitch, with the number of data being then different. That is, if the effective frequency band is up to 3400 kHz, this effective band is split into 8 to 63 bands depending on the pitch. Thus, the number of the amplitude data |Am|, obtained from band to band, also differs from 8 to 63. Thus, the data number conversion unit converts the variable number of amplitude data to a fixed number of data, such as 44 data.

The fixed numbers of, for example, 44, amplitude data or envelope data from the data number conversion unit provided in the output of the spectral envelope evaluation unit 115 or the input of the spectral envelope quantization unit 116 are collected by the spectral envelope quantization unit 116 every pre-set number of data, such as every 44 data, to form vectors, which are then processed with weighted vector quantization. This weighting is accorded by an output of the perceptually weighted filter calculation unit 134. The indices of the envelope from the spectral envelope quantization unit 116 are sent to the switching unit 107.

The phase detection unit 141 detects the phase information, such as the phase or the fixed delay components, for each harmonics of the sine wave analysis synthesis encoding, as later explained, and sends the phase information to a phase quantizer 142 for quantization. The quantized phase data is sent t the switching unit 107.

The switching unit 107 is responsive to the V/UV discrimination output from the V/UV discriminating unit 115 to switch between the pitch of the first encoding unit 110, phase and vector quantization indices of the spectral envelope and the shape or gain from the second encoding unit 120 as later explained to output the selected data at an output terminal 103.

Figure 2:
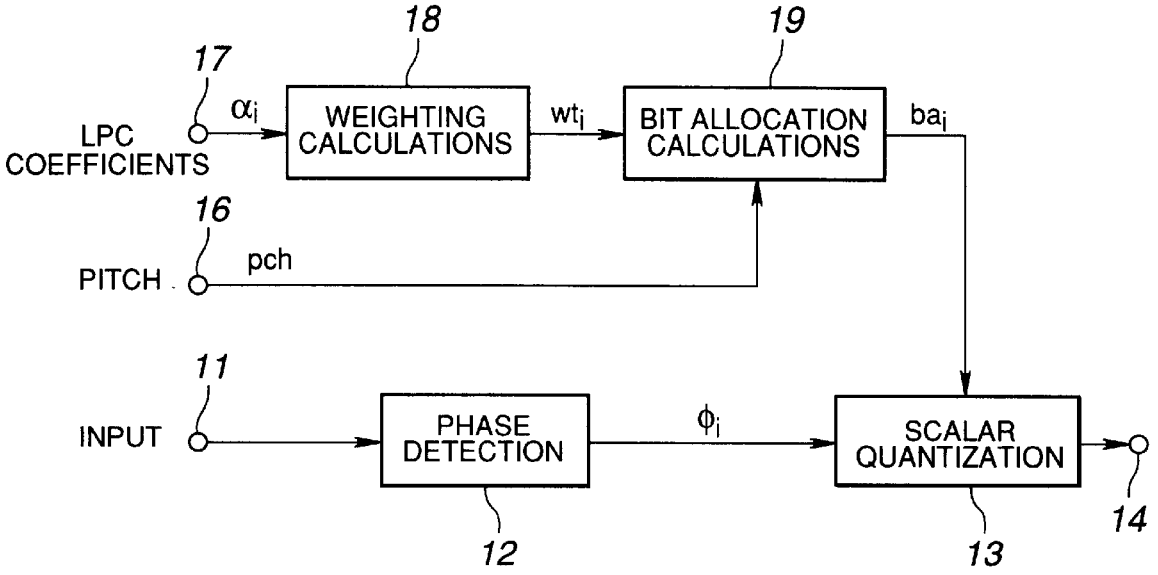
FIG. 2 is a schematic block diagram showing the structure of a phase quantization device embodying the present invention.

The second encoding unit 120 of FIG. 2 has a code excited linear prediction (CELP) encoding configuration. The second encoding unit 120 performs vector quantization of the time-axis waveform employing a closed search loop which uses an analysis-by-synthesis method of synthesizing an output of a noise codebook 121 using a weighted synthesis filter 122, sends the weighted speech to a subtractor 123, takes out an error with respect to the speech obtained on passing speech signals sent to an input terminal 101 through a perceptually weighted filter 125, sends the error to a distance calculation circuit 124 to calculate the distance and which searches the vector minimizing the error by the noise codebook 121. This CELP encoding is used for encoding the unvoiced portion as described above and the codebook index as UV data from the noise codebook 121 is taken out at an output terminal 107 via switching unit 107 which is changed over when the result of V/UV discrimination from the V/UV discriminating unit 115 indicates the invoiced (UV).

Referring to the drawings, preferred embodiments of the present invention will be hereinafter explained.

Although the method and the device of phase quantization according to the present invention are used for a phase quantizer 142 of the speech signal encoding apparatus shown in FIG. 1, this is of course not limiting the present invention.

FIG. 2 is a schematic block diagram showing a phase quantization device embodying the present invention. In this figure, a phase detection unit 12 and a scalar quantization unit 13 correspond to the phase detection unit 141 and the phase quantizer 142 of FIG. 1, respectively.

In FIG. 2, the input signal sent to the input terminal 11 is the digitized speech signal itself or short-term prediction residuals (LPC residual signals) of the digital speech signal, such as the signal rom the LPC inverted filter 131 of FIG. 1. The input signal is sent to the phase detection unit 12, adapted for detecting the phase information of high harmonics, in order to detect the phase information of the harmonics components. In FIG. 2, $\phi_i$ denotes the phase information of the ith harmonics. In this and other reference figures, the suffix i denotes the number of respective harmonics. The phase information $\phi_i$ is sent to a scalar quantizer 13 for scalar quantization so that the quantized output of the phase information, that is the indices, are taken at the output terminal 14. To the input terminal 16 of FIG. 2, there is supplied the pitch information pch from the high-precision pitch search unit 113 of FIG. 1. This pitch information is sent to a weighting calculation unit 18. To the input terminal 17 are fed LPC coefficients $\alpha_i$, which are the results of LPC analysis of the speech signals. Here, quantized and dequantized LPC coefficients $\alpha_i$ are used as values reproduced by the decoder. These LPC coefficients $\alpha_i$ are sent to the weighting calculation unit 18 for calculation of the weight $wt_i$ corresponding to the spectral amplitudes in the respective harmonics components as later explained. An output of the weighting calculation unit 18 (weight wt) is sent to a bit assignment calculation unit 19 for calculating the optimum number of assignment bits for quantization to the respective harmonics components of the input speech signal. The scalar quantizer 13 is responsive to this number of bit assignment $ba_i$ to quantize the phase information $\phi_i$ of the respective harmonics components from the phase detection unit 12.

Figure 3:
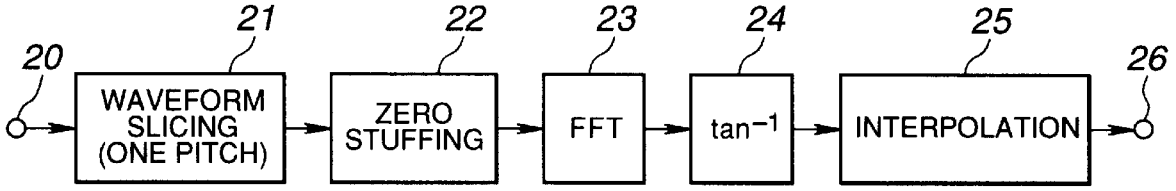
FIG. 3 is a schematic block diagram showing the structure of a phase detection device used in a phase quantization device embodying the present invention.
Figure 4:
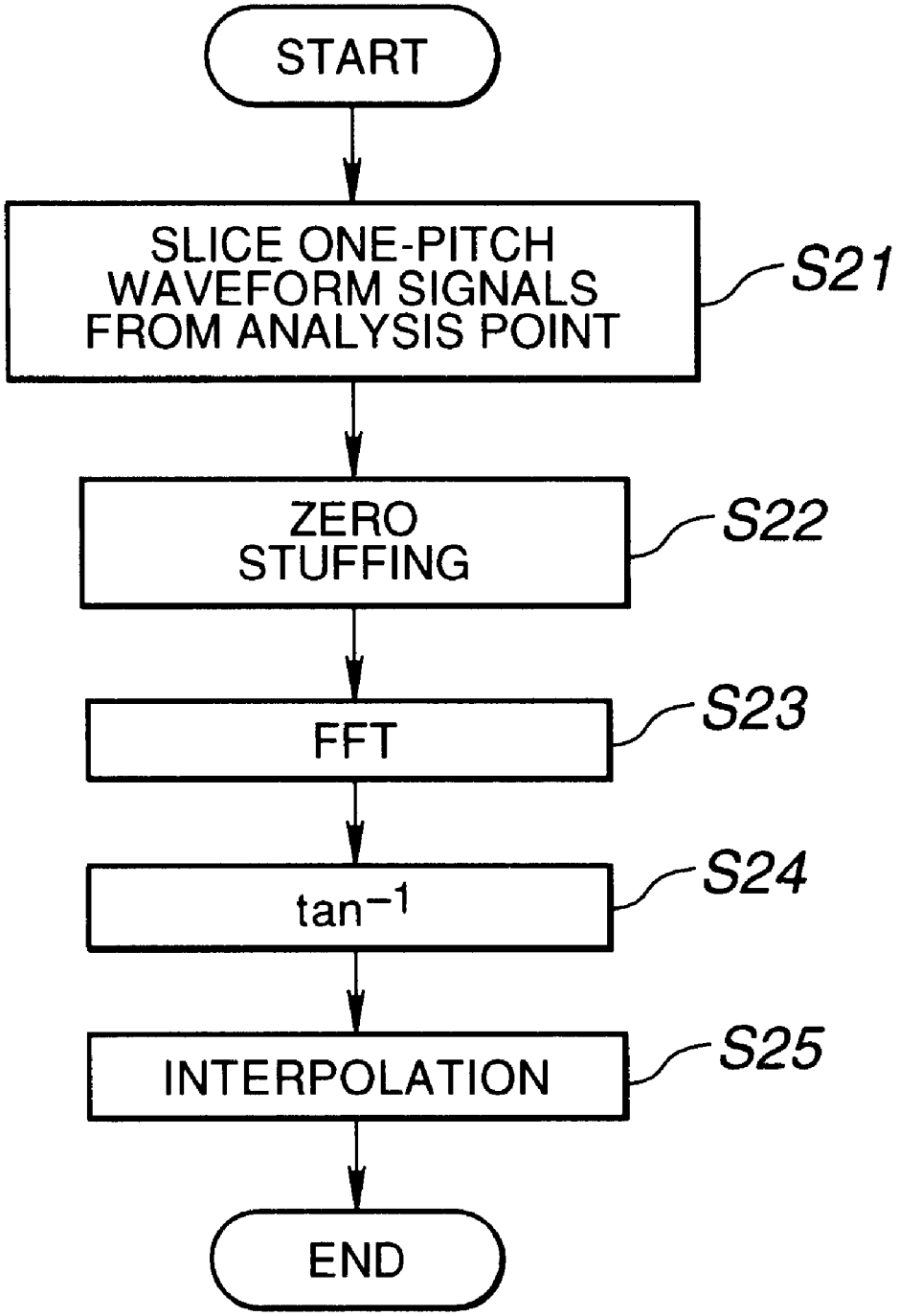
FIG. 4 is a flowchart for illustrating the phase detection method used in a phase quantization methods embodying the present invention.

FIGS. 3 and 4 are schematic block diagrams showing the structure and the operation of an embodiment of the phase detection unit 12 of FIG. 2, respectively.

Figure 5:
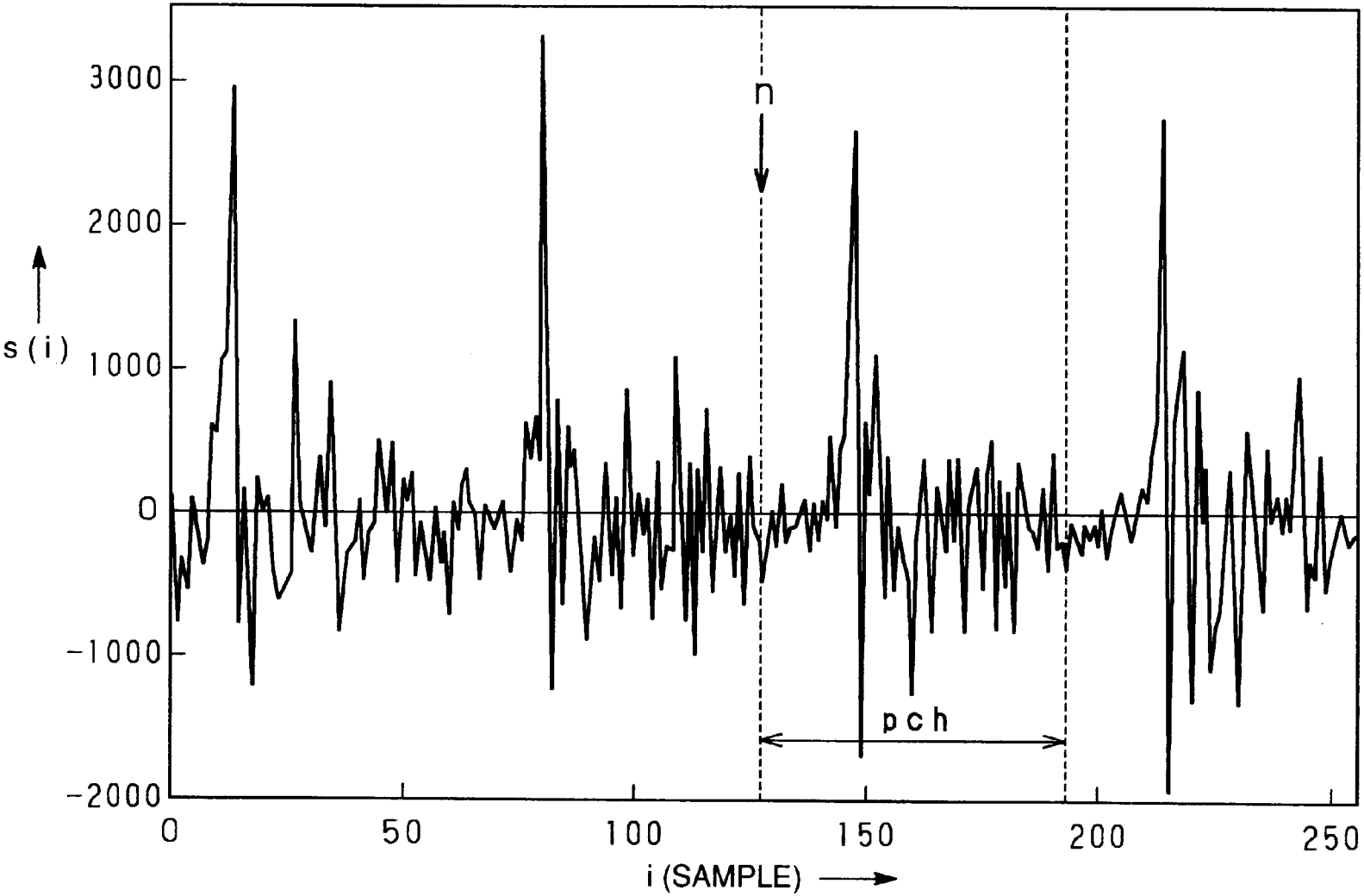
FIG. 5 is a wavelength diagram showing an example of input signals for phase detection.
Figure 6:
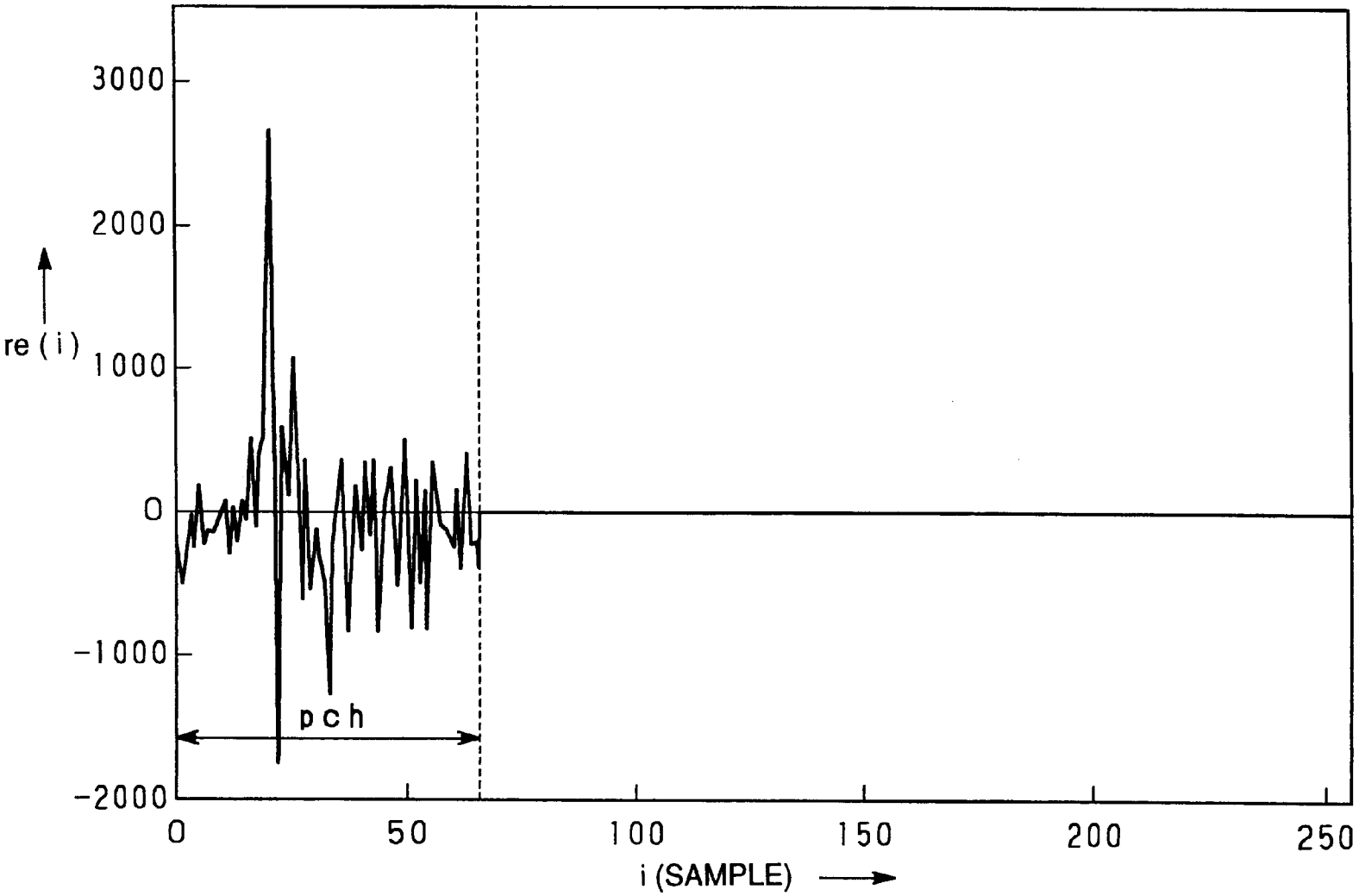
FIG.6 (PRIOR ART)
FIG. 6 is a waveform diagram showing typical signals obtained on zero padding in one-pitch waveform data.

An input terminal 20 of FIG. 3 is equivalent to the input terminal 11 of FIG. 2 and is the digitized speech signal itself or the short-term prediction residual signals (LPC residual signals) of the speech signals, as described above. A waveform slicing unit 21 slices a one pitch portion of the input signal, as shown at step S21 in FIG. 4. This operation is the processing of slicing a number of samples (pitch lag) pch corresponding to one-pitch period from an analysis point (time point) n of a block fthe input signal (speech signal or LPC residual signal) under analysis. Although the analysis block length is 256 samples in the embodiment of FIG. 5, this is merely illustrative and is not limiting the invention. The abscissa in FIG. 5 denotes the position or time in the block under analysis in terms of the number of samples, with the position of the analysis point or time point n denotes the nth-sample position.

For the sliced one-pitch waveform signal, zero-padding at step S22 is carried out by a zero-padding unit 22. This processing arrays the signal waveform of pch sample corresponding to one pitch lag at the leading end and padding 0s in the remaining positions so that the signal length will be equal to $2^N$ samples, herein $2^8=256$ samples (where $0 \leqq i \leqq 2N$).

$$\mathrm{re}(i) = \begin{cases} S(n+1) & (0 \le i < pch) \\ 0 & (pch \le i < 2^N). \end{cases} \tag{1}$$

This zero-padded signal string re(i) is set as a real part and an string of imaginary signals is set to im(i) and, using $$Im(i)=0(0 \leqq i<2^N)$$

the real number signal string re(i) and the imaginary number signal string im(i) are processed with $2^N$ point fast Fourier transform (FFT) as indicated at step S23 in FIG. 4.

For the results of FFT, $\tan^{-1}$ (arctan) is calculated, as shown at step S24 of FIG. 4, to find the phase. If the real number part and the imaginary number part of the results of FFT are Re(i) and Im(i), respectively, since the component of $0 \leqq i<2^{N-1}$ corresponds to the component 0 to $\pi$ (rad) on the frequency axis, $2^{N-1}$ points of the phase $\phi(\omega)$ on the frequency axis, where $\omega=0$ to $\pi$, are found by the equation (2):

$$\phi\left(\frac{i}{2^{N-1}}\pi\right) = \tan^{-1}\left(\frac{\mathrm{Im}(i)}{\mathrm{Re}(i)}\right) \quad (0 \le i \le 2^{N-1}). \tag{2}$$

Meanwhile, since the pitch lag of the analysis block, centered about the time n (samples), is pch samples, the fundamental frequency (angular frequency) $\omega_0$ at the time n is $$\omega_0=2\pi/pch \tag{3}$$

M harmonics are arrayed in a range of $\omega=0$ to a on the frequency axis at an interval of $\omega 0$. This number M is $$M=pch/2. \tag{4}$$

The phase $\phi(\omega)$, as found by the tan−1 processor 24, is the phase of a point 2N−1 on the frequency axis, as determined by the analysis block length and the sampling frequency. Thus, for finding the phase of the harmonics arrayed at the interval of the fundamental frequency $\omega_0$, the interpolation processing shown at step S25 of FIG. 4 is carried out by an interpolation unit 25. This processing finds the phase of the mth harmonics $\phi_m=\phi(m X \omega_0)$ where $1<m \leqq M$ by linear interpolation etc based on the 2N−1 point phase $\phi(\omega)$ found as described above. The phase data of the harmonics, as interpolated, ae taken out at an output terminal 26.

The case of linear interpolation is explained with reference to FIGS. 8 and 9, in which id, idL, idH, phase L and phase H are as follows:

$$id=mX\omega_0 \tag{5}$$

$$idl=\lfloor id \rfloor=\mathrm{floor}(id) \tag{6}$$

$$idH=\lfloor id \rfloor=\mathrm{ceil}(id) \tag{7}$$

$$phaseL = \phi\left(\frac{idL}{2^{N-1}}\pi\right) \tag{8}$$

$$phaseH = \phi\left(\frac{idH}{2^{N-1}}\pi\right) \tag{9}$$

where $\lfloor x \rfloor$ is a a maximum integer not exceeding x and may also be expressed as floor(x) and $\lceil x \rceil$ is a minimum integer larger than x and may also be expressed as ceil(x).

That is, the position on the frequency axis corresponding to the phase of the $2^{N-1}$ point as found is expressed by an integer number (sample number) and, if the frequency id ($=mX\omega 0$) of the mth harmonics exists between the two neighboring positions idl and idH in these $2^{N-1}$ points, the phase $\phi_m$ at the frequency id of the mth harmonics is found by linear interpolation using the respective phases phaseL, phase H of the respective positions idL and idH. The equations for his linear calculation is as follows:

$$\phi_m=(idH-id)\times(\mathrm{phase}L+2\pi)+(id-idL)\times\mathrm{phase}H$$

(phaseL<½π and phaseH>½π)

$$\phi m=(idH-id)\times\mathrm{phase}L+(id-idL)\times\mathrm{phase}H \tag{10}$$

(otherwise)

Figure 8:
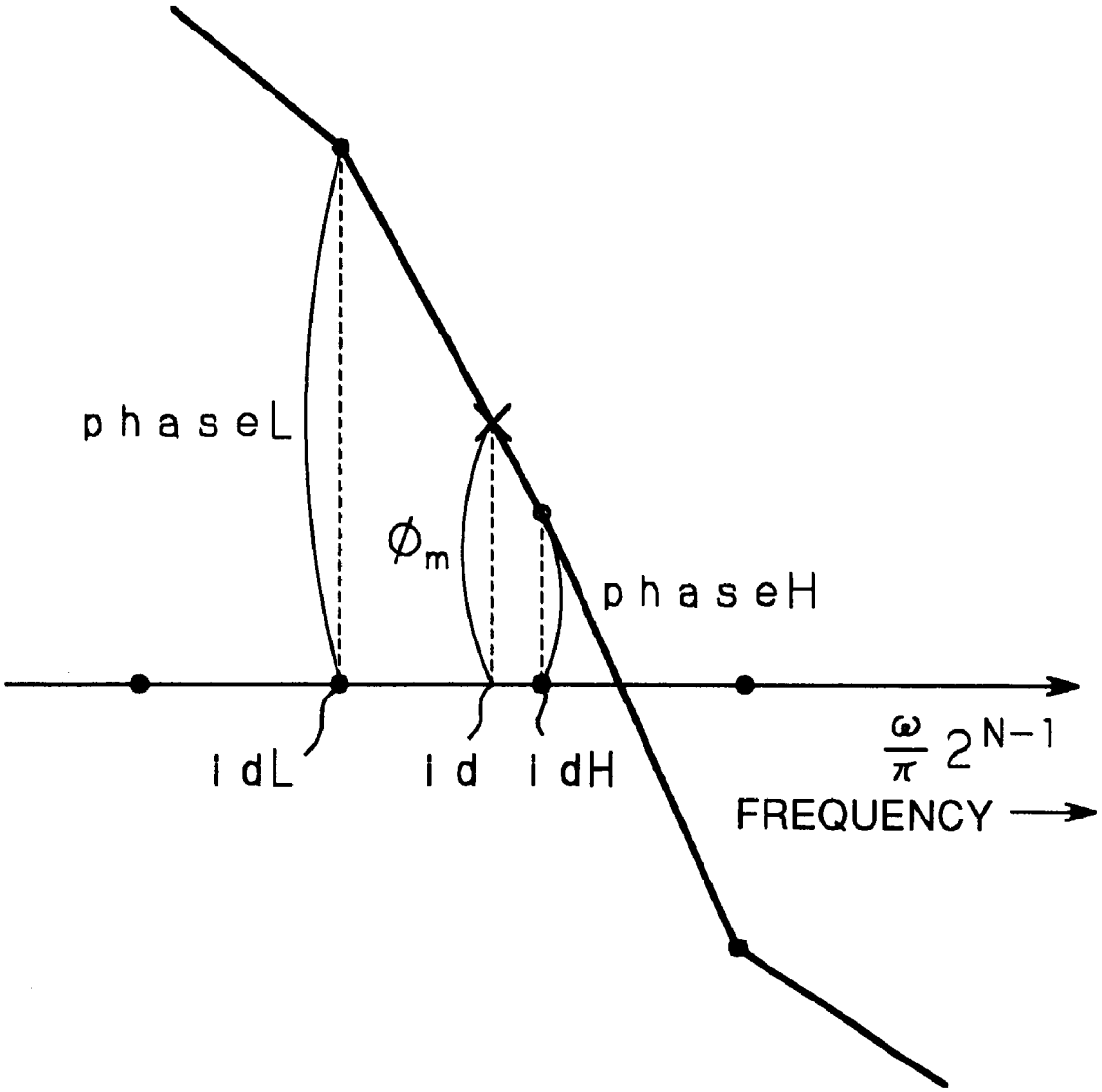
FIG. 8 illustrates an example of interpolation processing in case of a continuous phase.

FIG. 8 shows a case of simply linearly interpolating the phaseL and phaseH of two neighboring positions of the $2^{N-1}$ points to calculate the phase $\phi^m$ at the position of the mth hannonics id.

Figure 9:
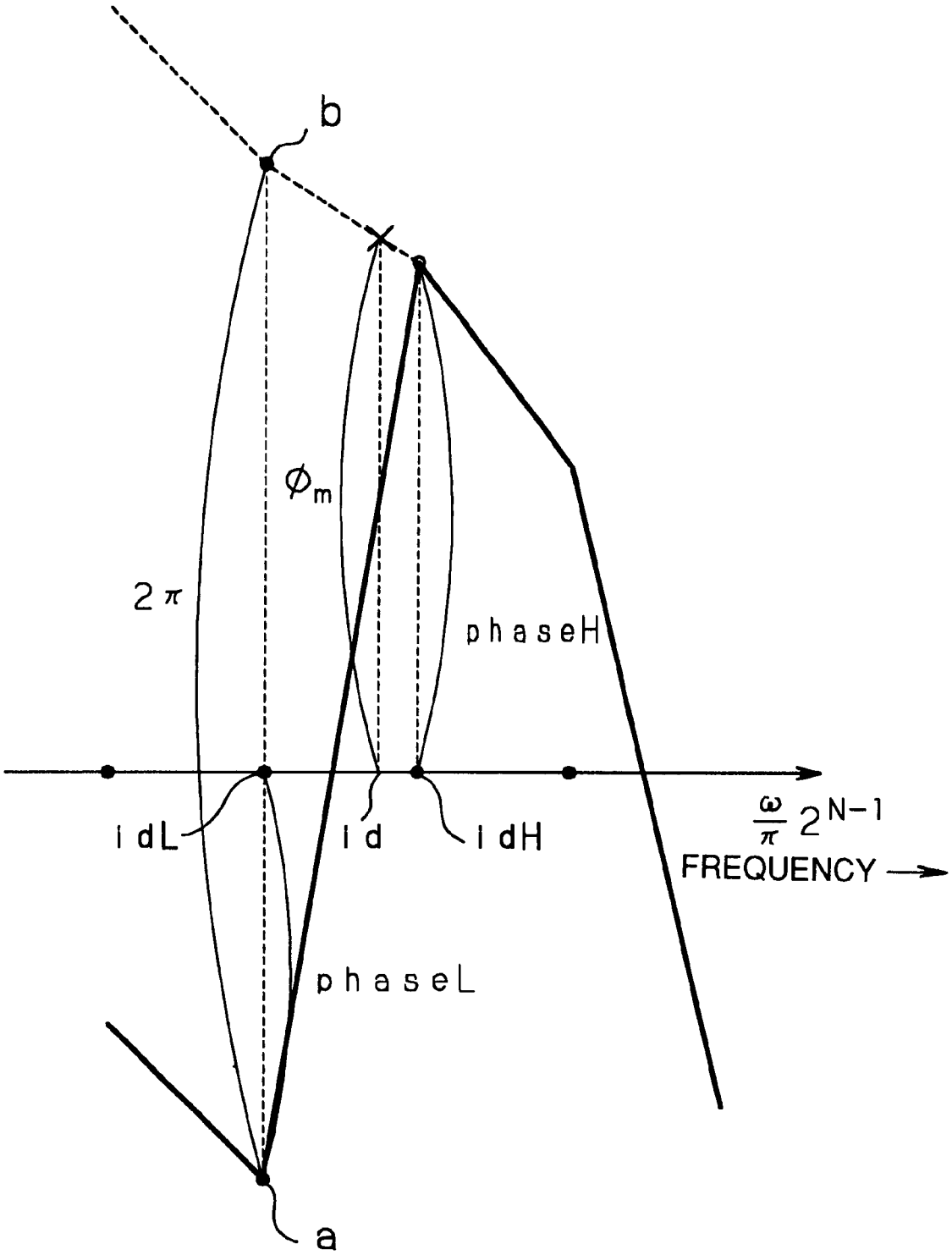
FIG. 9 illustrates an example of interpolation processing in case of a non-continuous phase.

FIG. 9 shows an example of interpolation processing which takes account of phase non-continuity. Specifically, the phase $\phi_m$ obtained on doing calculations of $\tan^{-1}$ is continuous over a $2\pi$ period, the phase $\phi_m$ at the position of the mth harmonics is calculated by the linear interpolation employing the phase L (point a) at the position idL on the frequency axis added to with $2\pi$ (point b) and the phase at the position id or phaseH. The processing for maintaining the phase continuity by addition of $2\pi$ is termed phase unwrapping.

Figure 7:
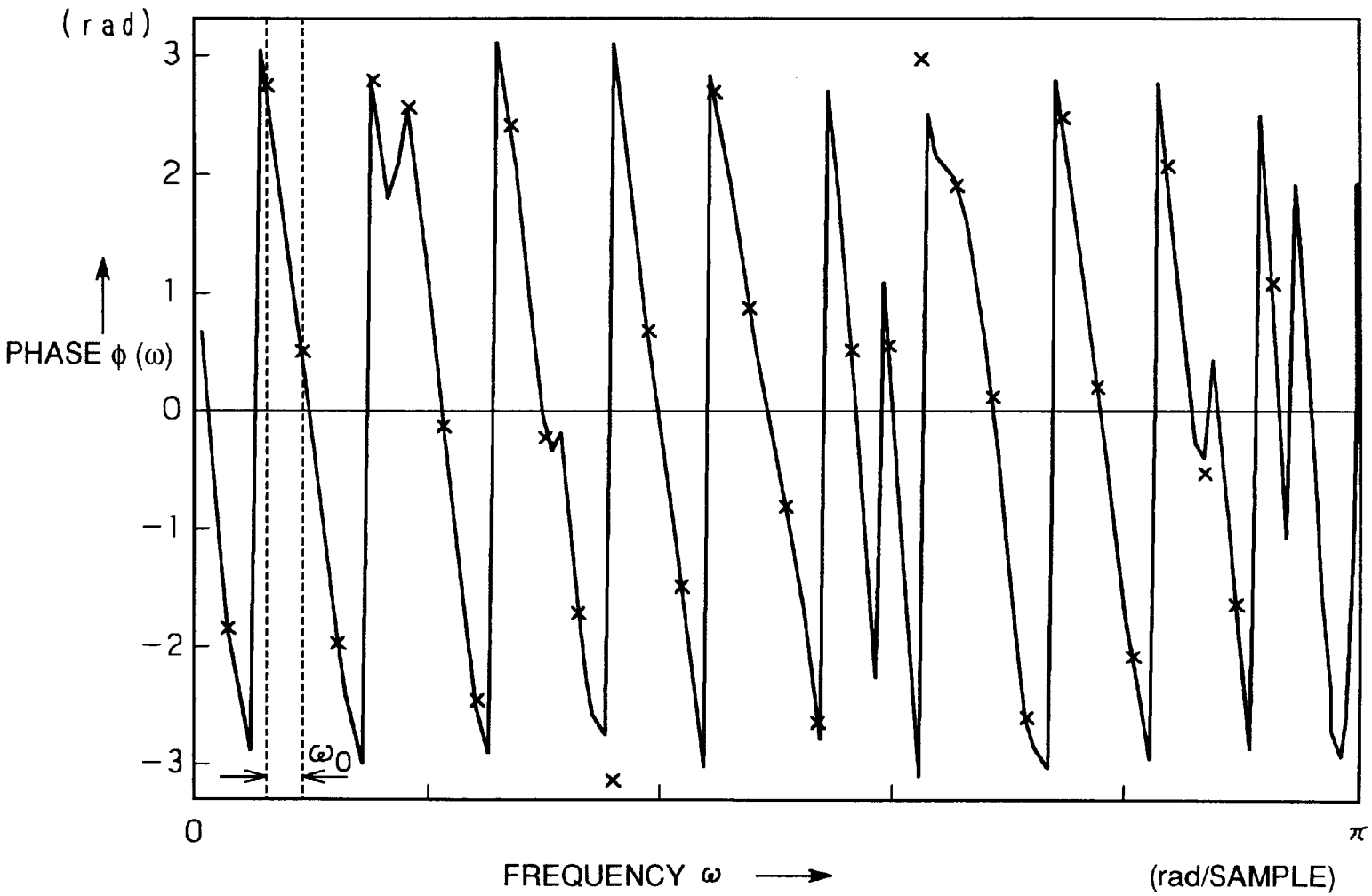
FIG. 7 shows an example of the detected phase.

On a curve of FIG. 7, an X mark indicates the phase of each harmonics thus found.

Figure 10:
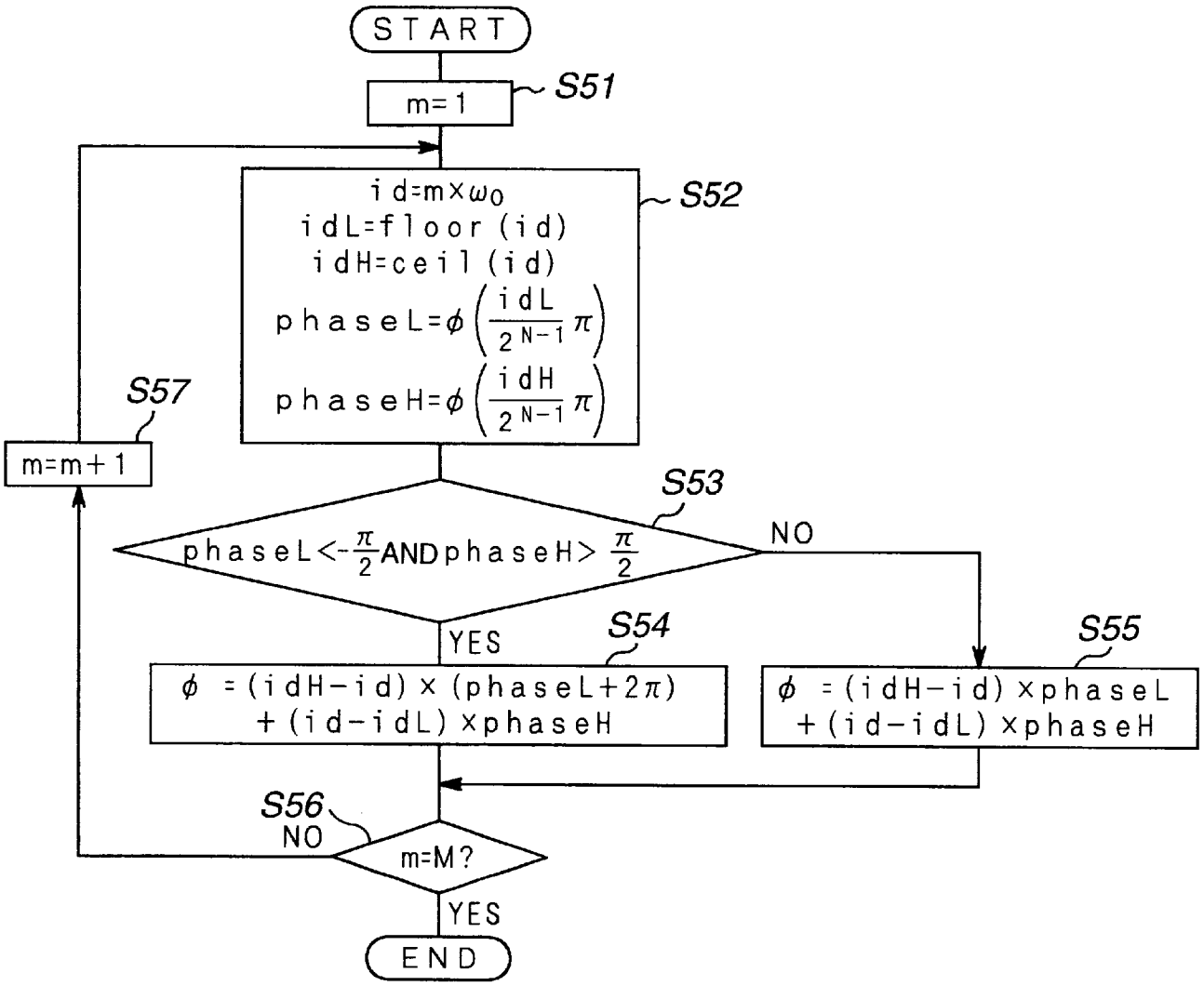
FIG. 10 is a flowchart for illustrating an example of the processing sequence for linear phase interpolation.

FIG. 10 is a flowchart showing the processing sequence for calculating the phase $\phi_m$ of each harmonics by linear interpolation as described above. In the flowchart of FIG. 10, the number of harmonics m is initialized (m=10) at the first step S51. At the next step S52, the above values id, idL, idH, phaseL and phaseH are calculated for the mth harmonics. At the next step S53, the phase continuity is discriminated. If the phase is found to be non-continuous at this step, processing transfers to step S54 and, if otherwise, processing transfers to step S55. That is, if the phase is found to be discontinuous, processing transfers to step S54 to find the phase $\phi_m$ of the mth harmonics by linear interpolation employing the phase of the position idL on the frequency axis phasel added to with $2\pi$ and the phase of the position idH phaseH. If the phase is found to be continuous, processing transfers to step to step S55 to simply linearly interpolate phaseL and phaseH to find the phase $\phi_m$ of the mth harmonics. At the next step S56, it is checked whether or not the number of the harmonics reaches M. If the result is NO, m is incremented (m=m+1) to revert to step S52. If the result is YES, processing comes to a close.

Reverting to FIG. 2, the manner in which the optimum number of quantization bits for the respective harmonics of the speech signal is explained for a case in which the phase information of the respective harmonics as found by the phase detection unit 12 is quantized by the scalar quantizer 13. In the following description, the phase or the coefficient associated with the ith harmonics are denoted by suffices i.

The fundamental frequency of the current frame (angular frequency) is $$\omega_0=90/pch \tag{11}$$

as indicated by the equation (3). For indicating to which frequency range of the harmonics the quantization is to be made, a real constant number bw ($0<bw\leqq 10$ is introduced. The number of harmonics M present in the range of frequency $0\leqq\omega\leqq bw \times \pi$ is expressed by the following equation (12):

$$M=\left\lfloor bw\times\frac{pch}{2}\right\rfloor. \tag{12}$$

Using the order-P quantization LPC coefficient $\alpha_i$ ($1\leqq i\leqq P$) sent to the terminal 17 of FIG. 2, the optimum numbers of bits for the respective harmonics are calculated by the weighting calculation unit 18 and the calculation unit for the assignment bits 19. This optimum quantization bit assignment can also be determined depending on the strength of the phoneme in each harmonics. Specifically, it can be found by calculating the spectral amplitude characteristics $wt_i$ ($i\leqq i\leqq M$) in each harmonics from the quantization LPC coefficients $\alpha_i$. That is, the order-P LPC inverted filter characteristics are found by the following equation (13):

$$H(z)=\frac{1}{1+\sum_{i=1}^{P}\alpha_i z^{-i}}. \tag{13}$$

The impulse response of a suitable length of the inverted LPC filter characteristics is then found and processed with 2N-point FFT to find FFT output $H(\exp(-j\omega))$ of the 2N−1 points in a range of $0\leqq\omega\leqq\pi$. The absolute value is the above-mentioned spectral amplitude characteristics $wt_i$ as indicated in the equation (14):

$$wt(\omega)=|H(e^{-j\omega})| \tag{14}$$

Since the fundamental frequency of the current frame is $\omega_0$, the spectral amplitude $wt_i$ ($1\leqq i\leqq M$) in each harmonics component can be found from wt(floor ($\omega_0$X i) and wt(ceil ($\omega_0$X i)) by suitable interpolation. Meanwhile, floor(x) and ceil(x) denote a maximum integer nor exceeding x and a minimum number larger than x, respectively, as explained previously.

If B is the total number of bits allowed for phase quantization and $ba_i$ is the number of quantization bits assigned to the ith harmonics, it suffices if a suitable offset constant C which satisfies the equations (15) and (16):

$$ba_i=\text{init}(\log_2(wt_i)+C) \tag{15}$$

$$B=\sum_{i=1}^{M} ba_i \tag{16}$$

is found. It is noted that there is a limitation due to the minimum number of bit assignment.

Figure 12:
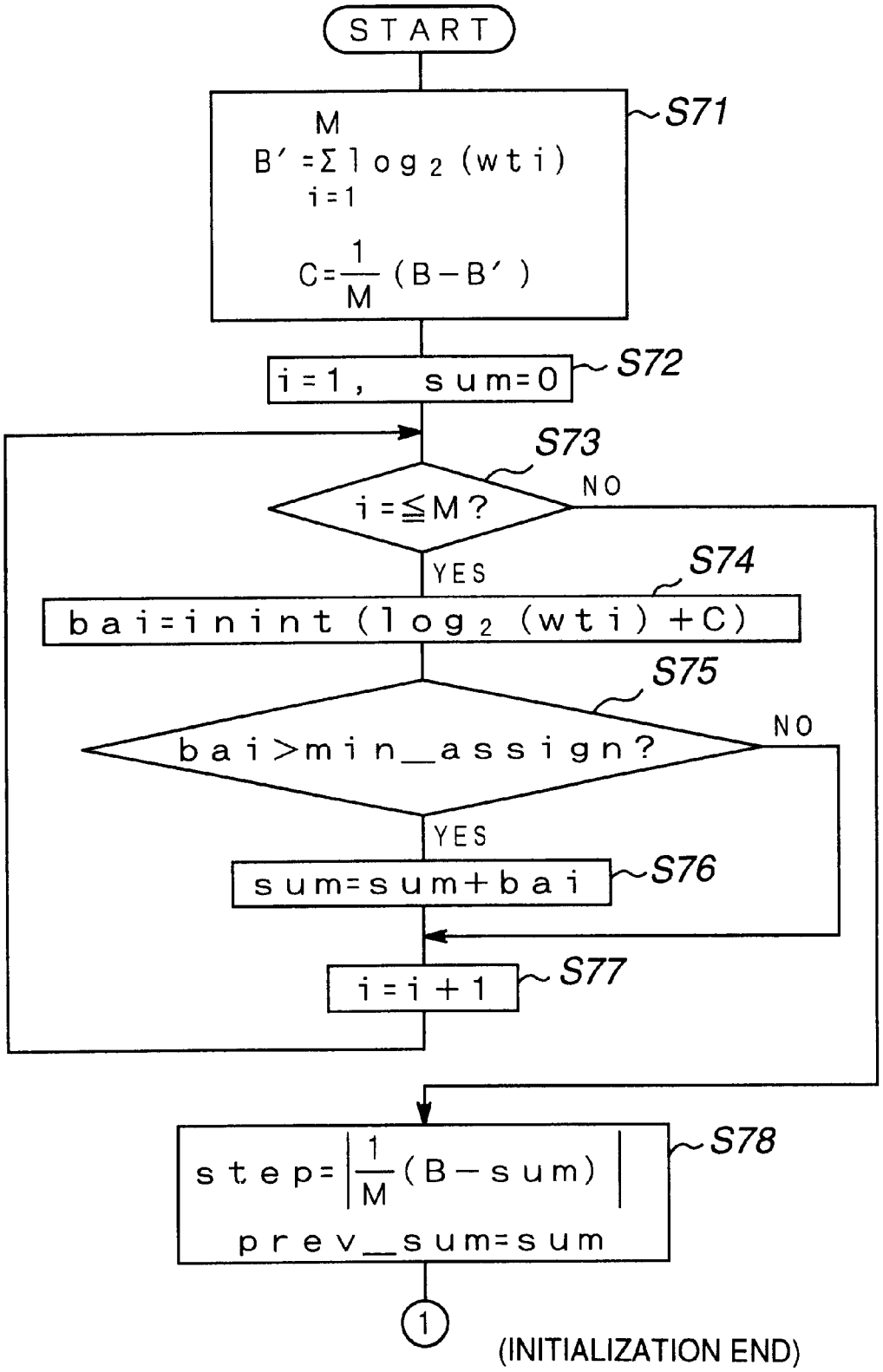
FIG. 12 is a flowchart showing an example of calculations of quantization bit assignment.
Figure 13:
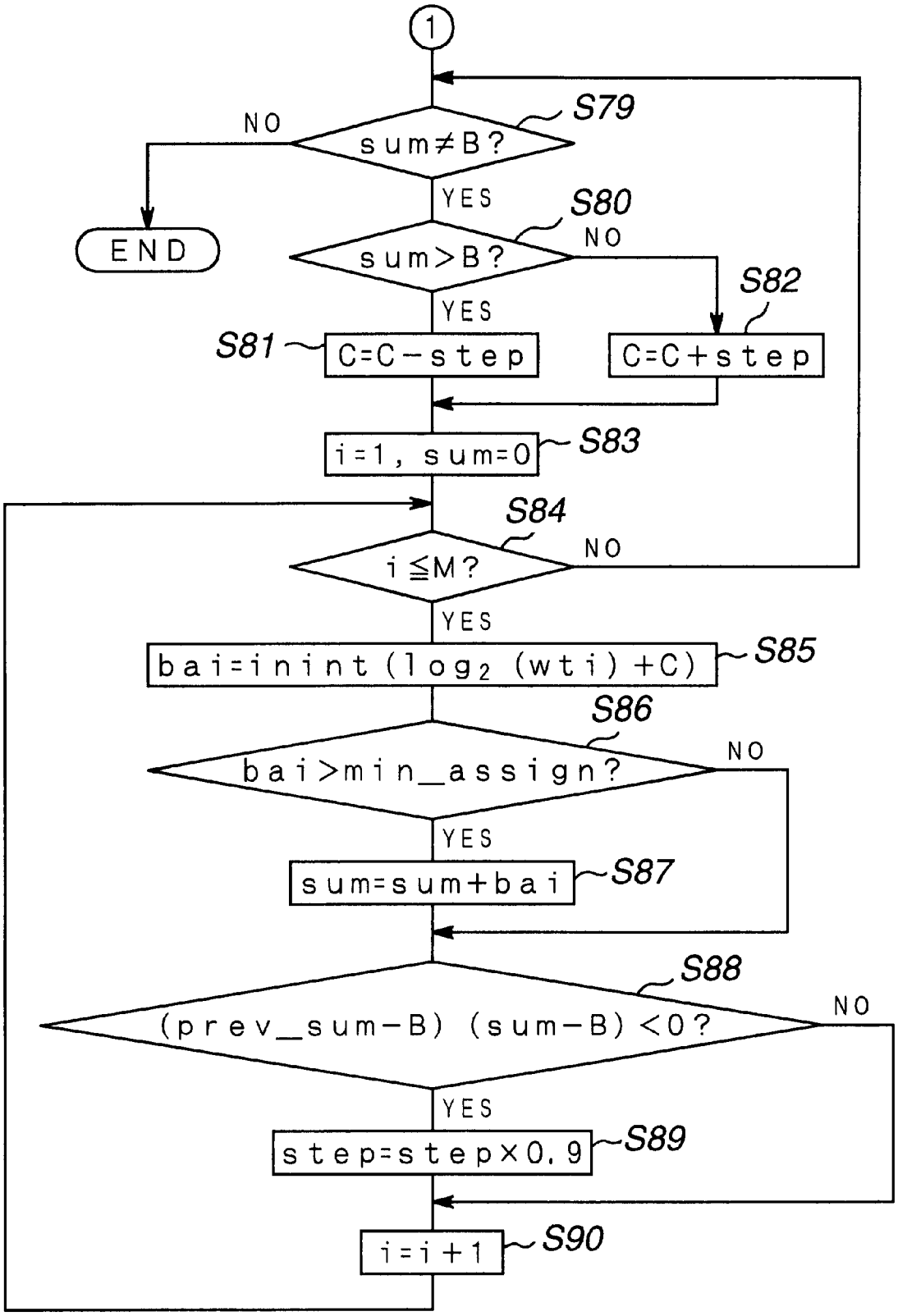
FIG. 13 a flowchart, continuing to FIG. 12, showing an example of calculations of quantization bit assignment.

In the above equation (15), init(x) denotes an integer closest to the real number x. FIGS. 12 and 13 show an illustrative example of the calculations. The steps from step S71 to step S78 of FIG. 12 show initial setting for previously finding the step value step for adjusting the offset constant C used for bit assignment or the provisional sum value prev_sum. By the steps of step S79 to step S90 of FIG. 13, the offset constant C is adjusted until the sum value sum of the number of bit assignment for each harmonics coincides with the total number of bits B previously accorded to the phase quantization.

That is, at the step S71 of FIG. 12, the difference between the total number of bit assignment B' provisionally found on the basis of the spectral amplitudes $wt_i$ of the respective harmonics and the previously allowed total number of bits B is divided by the number of the harmonics M and the resulting quotient is provisionally set as the offset constant C. At the next step S72, the control variable i for repetitive processing, corresponding to the number of the harmonics, and the total sum (sum) are initialized (i=1, sum=0). Then, by the steps S73 to S77, the numbers of bit assignment $ba_i$, calculated using the provisionally set offset constant C, are cumulatively summed until i reaches M. At the next step S78, the step value step for adjusting the offset constant C is found and the sum (sum) is substituted into prev_sum. At step 579 of FIG. 13, it is discriminated whether or not the sum (sum) is not coincident with the total number of bit assignment B. If the result of check is YES, that is if the sum (sum) is not coincident with the total number of bit assignment B, the processing from step S80 to S90 is repeated. That is, the sum is compared to b at step S80 and, depending on the magnitude of the result of comparison, the offset constant C is deceased or increased by the step value step at steps S81 and S82. At the steps of from step S83 to step S90, bit assignment for the respective harmonics is carried out using the adjusted offset constant C to again find the sum (sum) of the number of bit assignment to revert to step S79. The value m_assign of step S75 indicates the minimum number of bit assignment per harmonics. The minimum number of bit assignment min_assign is usually set t 2 bits or thereabouts inconsideration that transmission of the one-bit phase information is not that meaningful.

The sequence of calculations shown in FIGS. 12 and 13 is merely illustrative and may suitably be modified or, alternatively, the number of bit assignment per harmonics may be calculated by other suitable methods.

Figure 14:
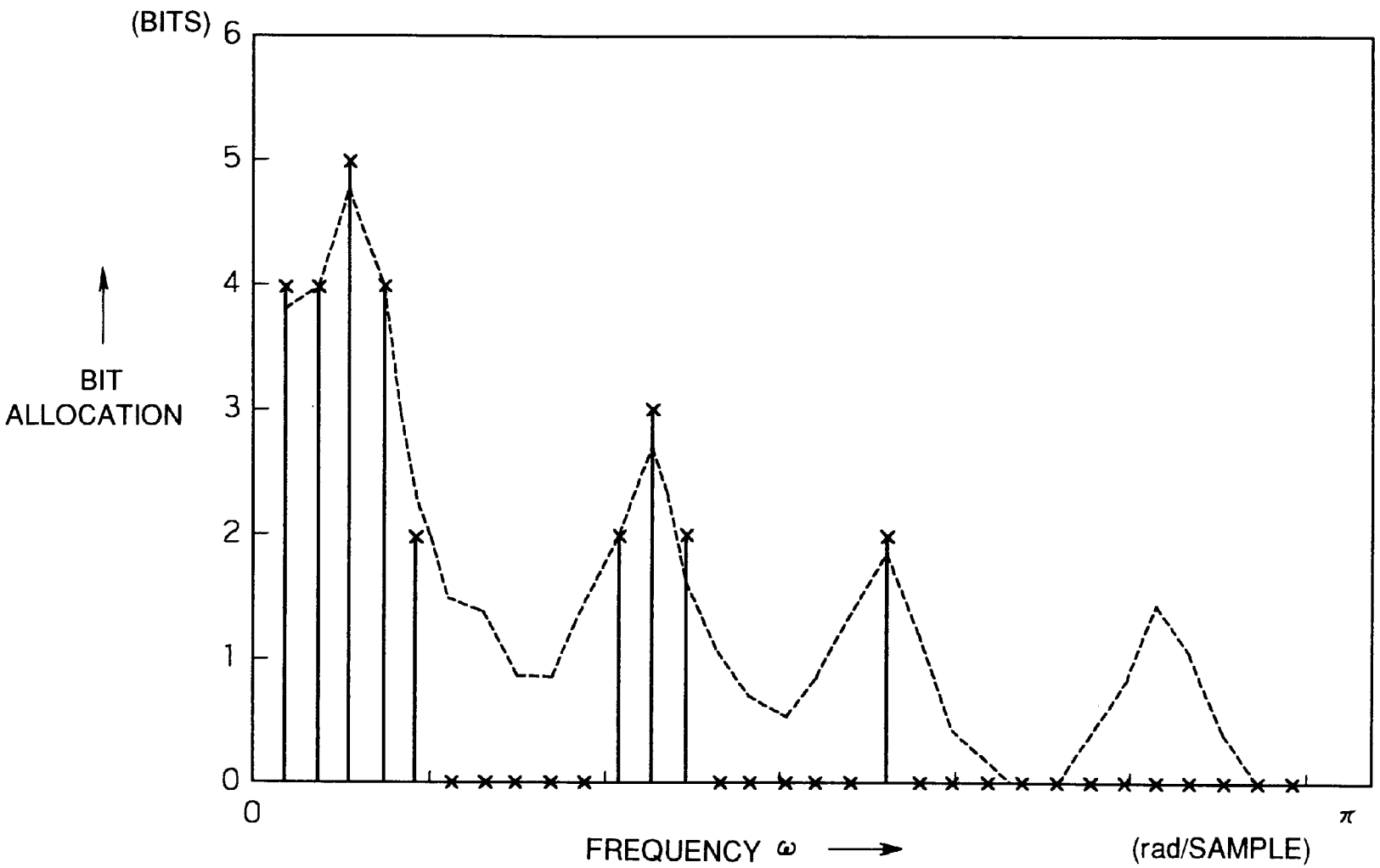
FIG. 14 shows an example of assignment of quantization bits of respective harmonics.
Figure 15A:
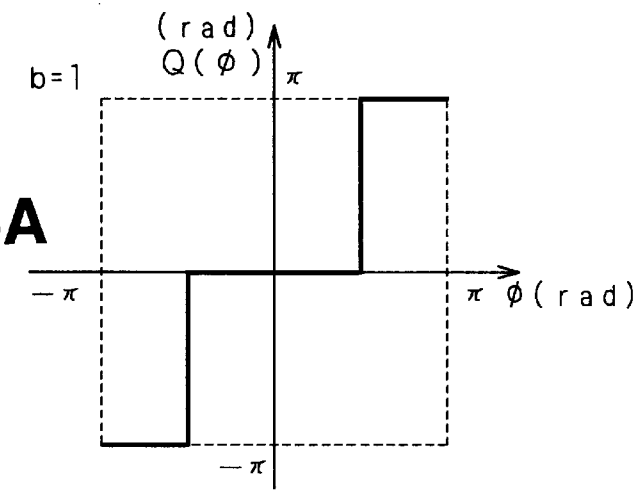
FIGS. 15A to 15D show an example of scalar quantization of the detected phase on the assignment bit basis.
Figure 15B:
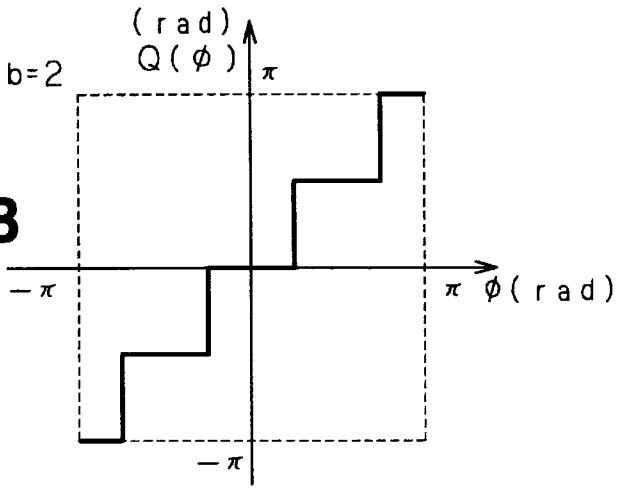
Figure 15C:
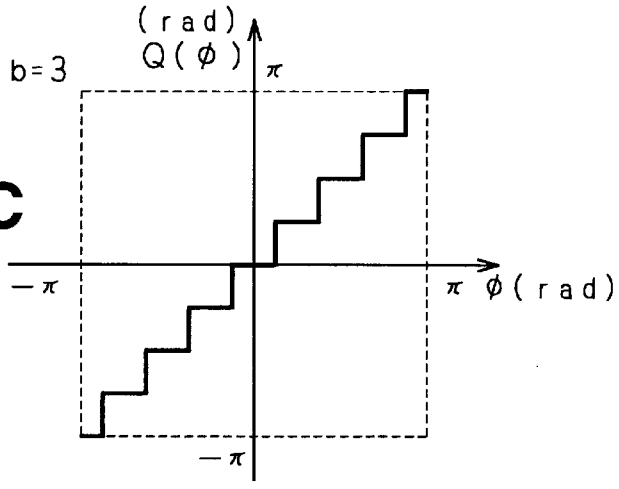
Figure 15D:
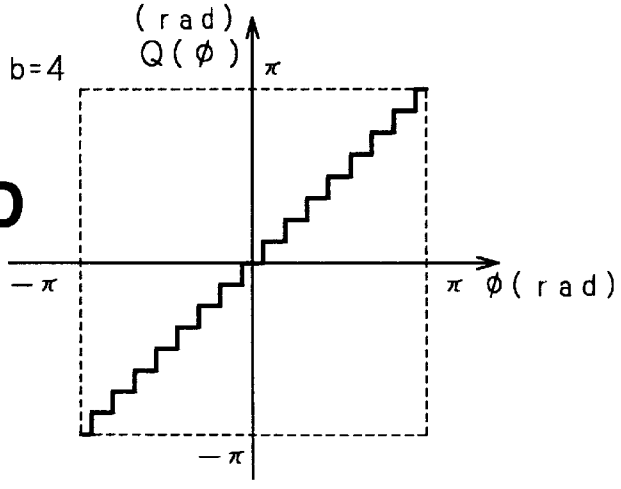

FIG. 14 shows an example of the number of quantization bits $ba_i$ is found by calculating the assignment for respective harmonics. In the present specified example, the total number of bits b is 28, the constant bw determining the range of quantization to be quantized is 0.95, and the minimum number of bits min_assign is two bits.

The scalar quantizer 13 is responsive to the number of bit assignment bai obtained from the bit allocation calculation unit 19 of FIG. 2 to scalar-quantize the detected phase $\phi_i$ of the respective harmonics from the phase detection unit 12 to obtain phase quantization indices. The quantization phase $Q(\phi)$, obtained on quantizing the detection phase $\phi$ in case of the number of assignment of quantization bits equal to b (bits) is expressed by the following equation (17):

$$Q(\phi) = \frac{\pi}{2^{b-1}} \times \left\lfloor \frac{2^{b-1}}{\pi}\left(\phi + \frac{\pi}{2^b}\right)\right\rfloor. \tag{17}$$

FIG. 15 shows an example of scalar quantization of the phase responsive to the number of assigned bits. FIGS. 15A, B, C and D show the cases of the number of assigned bits b=1, b=2, b=3 and b=4, respectively.

As for the phase of the harmonics for which the number of assigned bits $ba_i$ is 0, that is for which the quantization phase is not sent, it suffices if a suitable value is inserted to execute sine wave synthesis.

Figure 16:
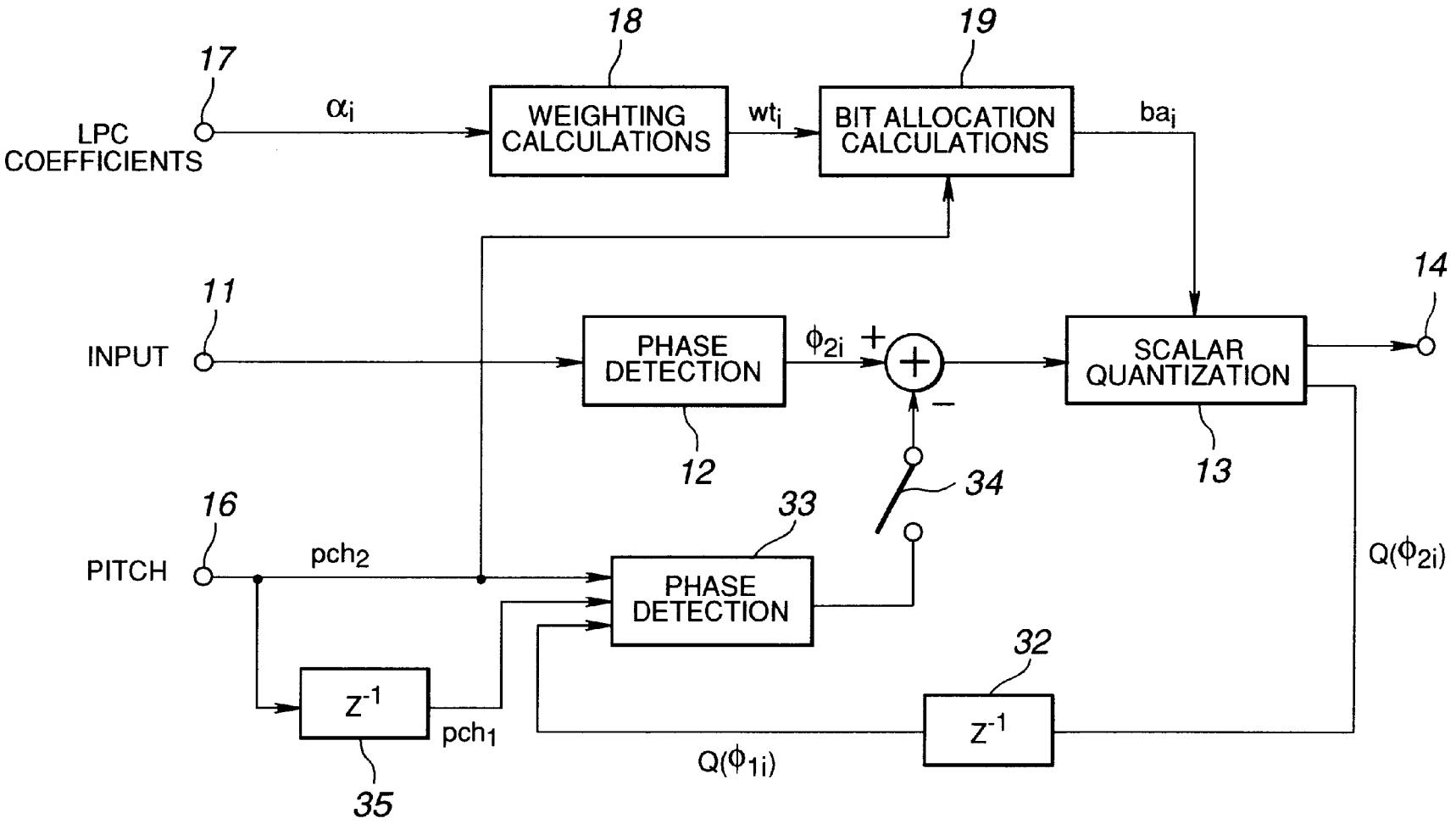
FIG. 16 is a schematic block diagram showing a phase quantization device according to another embodiment of the present invention.

Referring to FIG. 16, a modification of the present invention in which the phase of the respective harmonics components of the current frame is produced from the results of phase quantization of the previous frame and the prediction error is scalar-quantized responsive to the above-mentioned optimum number of assignment of quantization bits is explained.

In the modification of FIG. 16, a subtractor 31 for taking out the prediction error is connected between the phase detection unit 12 and the scalar quantizer 13. The quantization phase from the scalar quantizer 13 is delayed one frame by a delay unit 32 and thence sent to a phase prediction unit 33. The predicted phase obtained by the phase prediction unit 33 is sent via switch 4 to the subtractor 31 where it is subtracted from the detected phase from the phase detection unit 12 to give a prediction error which is quantized by the scalar quantizer 13. The quantization of the prediction error is carried out only if the pitch frequency drift from the previous frame is in a pre-set range. Thus, the phase prediction unit 33 is fed with the current pitchpch2 from the input terminal 16 and the pitch pch1 of the previous frame obtained on delaying the current pitch pch2 by a one frame delay unit 35 to verify the pitch continuity based on these pitches pch1 and pch2. The suffices 1 and 2 to the pitch pch or the phase $\phi$ denote the previous frame and the current frame, respectively. The construction of FIG. 16 is otherwise the same as that of FIG. 2 and hence the corresponding parts are dented by the same reference numerals and are not explained specifically.

If the pitch frequency for the current pitch pch2 (angular frequency) is $\omega_{02}$ and the frequency corresponding to the pitch pch1 of the previous frame is $\omega_{01}$, the phase prediction unit 33 verifies whether or not the pitch frequency drift from the previous frame specifying the pitch frequency drift from the previous frame, indicated by the equation (18):

$$\left|\frac{\omega_{02} - \omega_{01}}{\omega_{02}}\right| \tag{18}$$

is in a pre-set range to verify whether the prediction error of the phase is to be quantized or the phase itself is to be quantized.

If the pitch frequency drift shown by the equation (18) is out of a pre-set range (pitch non-continuous), the phase of each harmonics are subjected to optimum pitch assignment and scalar-quantized, as in the embodiment of FIG. 2.

If the pitch frequency drift shown by the equation (18) is in a pre-set range (pitch continuous), the prediction phase $\phi'_{2i}$ of each harmonics of the current frame, where $1 \leqq i \leqq M_2$, is found, using the quantized phase $Q(\phi_{1i})$ of the previous frame, where $1 \leqq i \leqq M_1$, by the following equation (19):

$$\phi'_{2i} = Q(\phi_{1i}) + \frac{\omega_{01} = \omega_{02}}{2} \times L \times i \tag{19}$$

where 1 is a frame interval and $M_1 = pch_1/2$ and $M_2 = pch_2/2$.

At this time, the subtractor 31 calculates, by the equation:

$$\theta i = (\phi_{2i} - \phi'_{2i}) \bmod (2\pi) \tag{20}$$

a difference (prediction error) $\theta_1$ between the predicted phase $\phi'_{2i}$ found on calculating the equation (19) by the phase prediction unit 33 and the detected phase $\phi_{2i}$ of each harmonics from the phase detection unit 12, to send this prediction error $\theta_1$ to the scalar quantizer 13. The scalar quantizer 13 then scalar quantizes this prediction error $\theta_1$ to derive a quantization index.

A specified example of scalar quantization is now explained. The difference between the predicted phase $\phi'_{2i}$ and the detected phase $\phi_{2i}$ should exhibt distribution symmetrical about 0. An example of quantizing an error $\theta$ between the detected phase and the predicted phase in case the number of assigned quantization bits is b (bits) is shown by the following equation (21):

$$Q(\theta) = \frac{\delta}{2^{h-1}}\left\lfloor \frac{2^{h-1}}{\delta}\theta \right\rfloor \ (x \geq 0) \tag{21}$$

$$Q(\theta) = -\frac{2^{h-1}}{\delta}\left\lfloor -\frac{2^{h-1}}{\delta}\theta \right\rfloor \ (x \langle 0).$$

Figure 17A:
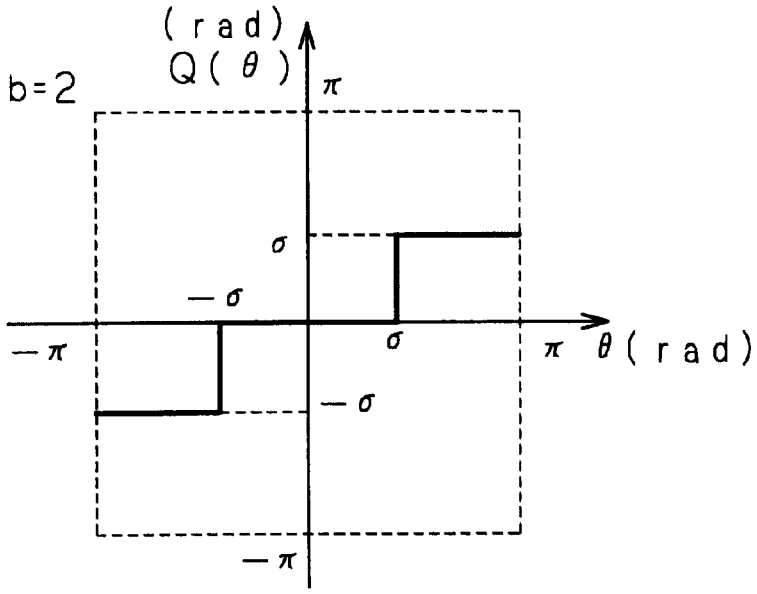
FIGS. 17A and 17B show an example of scalar quantization of the prediction phase error.
Figure 17B:
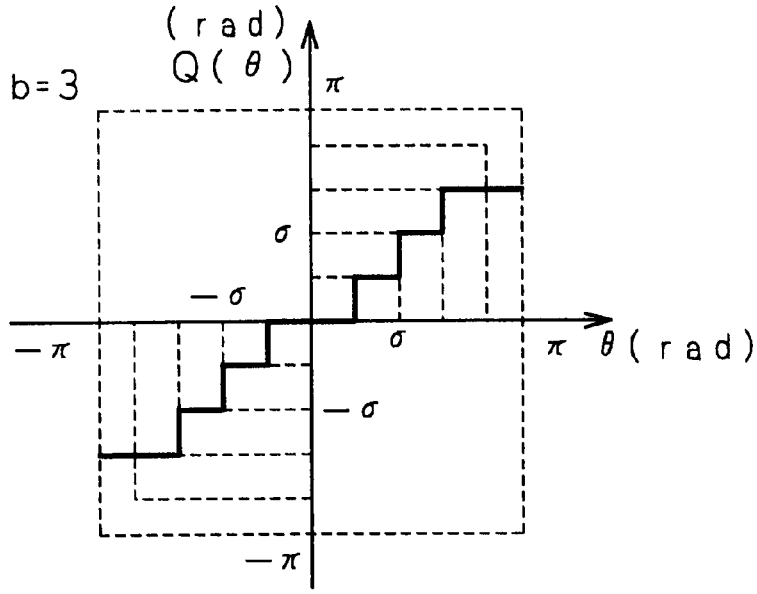
Figure 18A:
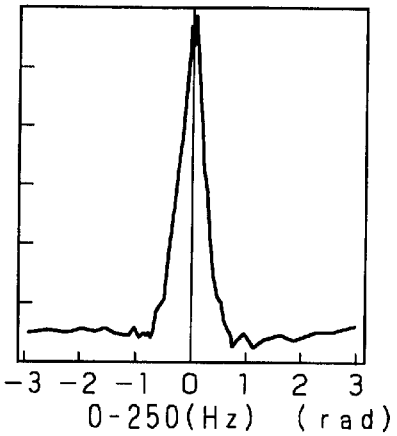
FIGS. 18A to 18F show the distribution of the predicted phase error on the frequency band basis.
Figure 18B:
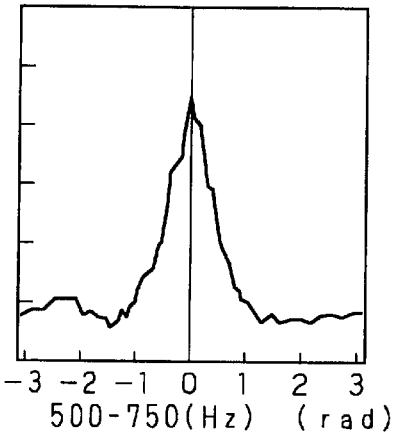
Figure 18C:
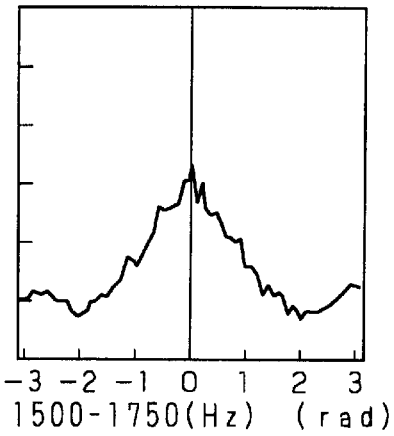
Figure 18D:
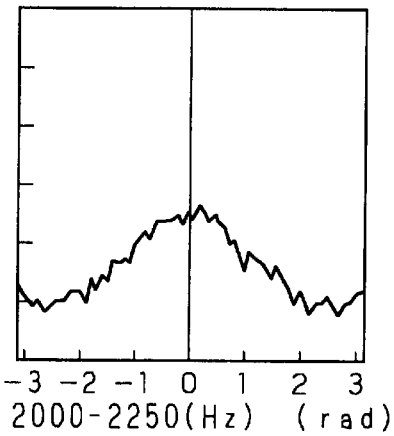
Figure 18E:
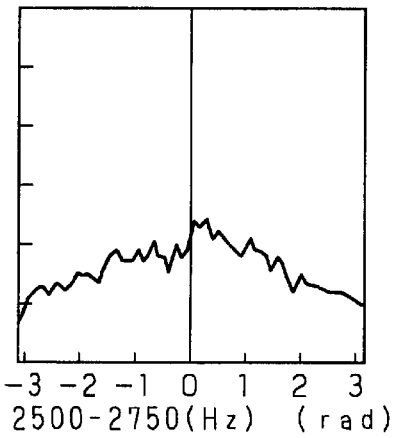
Figure 18F:
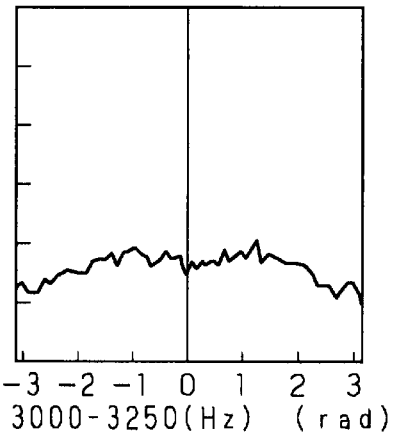

A specified example of quantization of the phase prediction error is shown in FIG. 17, in which FIG. 17A and FIG. 17B stand for the case of the number of assignment b of quantization bits equal to 2 and for the case of the number of assignment b of quantization bits equal to 3, respectively.

Meanwhile, the prediction error, which is the difference between the prediction error and the detection error, tends to be smaller and random in a direction towards the lower frequency and in a direction towards a higher frequency, respectively, a specified example of the distribution of the prediction error distribution is shown in FIG. 18, in which FIGS. 18A to F stand for the distribution of the phase prediction error in the frequency ranges of 0 to 250 Hz, 500 to 750 Hz, 1500 to 1750 Hz, 2000 to 2250 Hz, 2500 to 2750 Hz and 3000 to 3250 Hz, respectively. It is preferred to take this into account and to prepare quantization codebooks associated with bands and the number of quantization bits to select the codebooks used for quantization depending on the band of the harmonics in question and the assigned numbers of quantization bits by way of performing scalar quantization.

Figure 19:
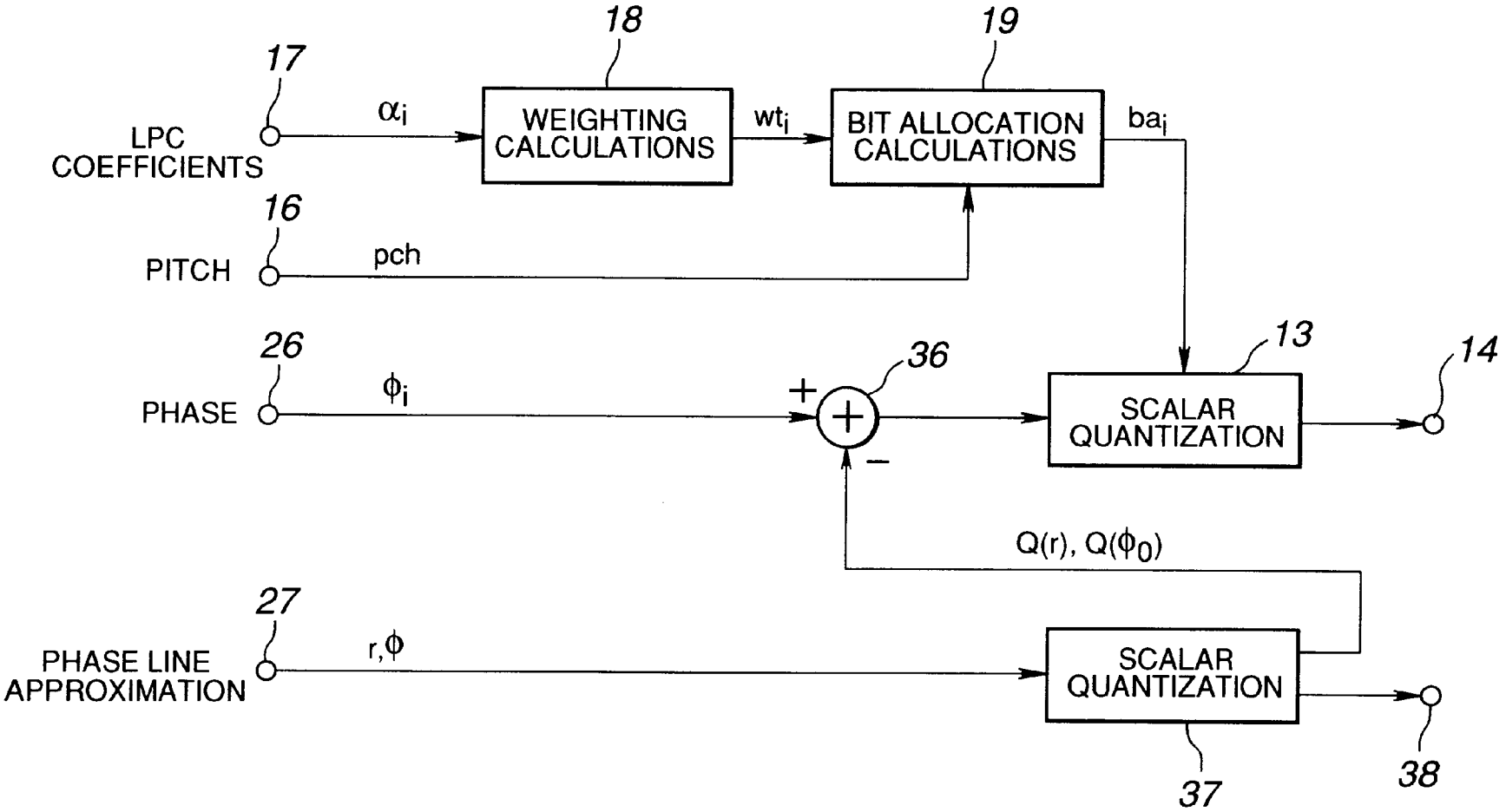
FIG. 19 is a schematic block diagram showing the structure of the phase quantization device according to a further embodiment of the present invention.

Referring to FIG. 19, another modification of the present invention is explained.

In the example of FIG. 19, the tilt (delay component) and the intercept of the least square linear approximation by the spectral amplitude of unwrap phase characteristics at a given time point of short-term prediction residual of the speech signal are scalar-quantized. The quantized linear phase by the quantized tilt and intercept is subtracted from the detected unwrap phase of each harmonics to find a difference which is scalar quantized responsive to the above-mentioned optimum number of quantization bits. That is, the detected phase from the phase detection unit 12 of FIGS. 2 and 16 is fed to the terminal 26 of FIG. 19 and thence supplied via subtractor 36 to the scalar quantizer 13. On the other hand, the linear phase approximation component, approximating the fixed delay component of the phase as later explained, is sent to the terminal 27 an quantized by the scalar quantizer 37 and thence supplied to the subtractor 36 where it is subtracted from the detected phase from the terminal 26 to give a difference which is sent to the scalar quantizer 13. The structure is otherwise the same as that in FIGS. 2 or 16 and hence the corresponding parts are depicted by the same reference numerals and are not explained specifically.

Figure 20:
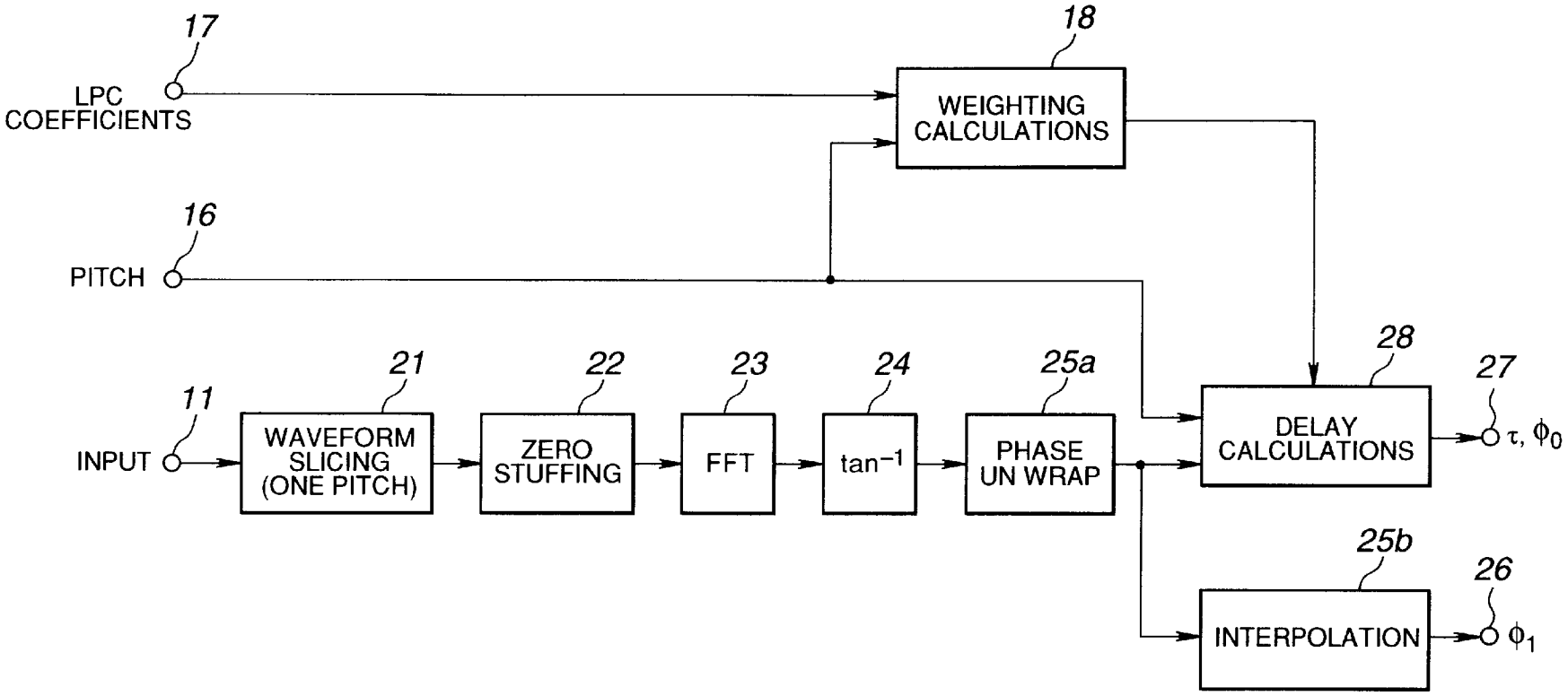
FIG. 20 shows an example of a structure used for finding linear phase approximation components as inputs to the phase quantization device shown in FIG. 19.

Referring to FIG. 20, the linear phase approximation components sent to the terminal 27 are explained with reference to 20 schematically showing the configuration for finding the fixed phase delay component by linear approximation of the unwrap phase.

In FIG. 20, an input signal sent to the input terminal 11 may be the digitized speech signal itself or short-term prediction residuals of the speech signal (LPC residual signal) as explained with reference to FIGS. 2 and 16. The structure from the waveform slicing unit 21 connected to the input terminal 11 up to the $\tan^{-1}$ processor 24 is the same as that shown in FIG. 3 and hence are not explained specifically. The detected phase data shown in FIG. 7 is obtained from the $\tan^{-1}$ processor 24.

The fixed phase delay component obtained from the $\tan^{-1}$ processor 24, that is the so-called group delay characteristics $\tau(\omega)$, is defined as the phase differential inverted in sign, that is as $$\tau(\omega)=-d\phi(\omega)/d\omega \quad (22).$$

The phase obtained from the tan−1 processor 24 is sent to a phase unwrap unit 25*a* of FIG. 20. Meanwhile, if desired to find the phase of each harmonics, the phase from the phase unwrap unit 25*a* needs to be sent to an interpolation processor 25*b* to execute interpolation, such as linear interpolation. Since it suffices for the interpolation processor 25*b* to interpolate the previously unwrapped phase, simple linear interpolation suffices, without it being necessary to make the interpolation under simultaneous phase discontinuity decision as in the case of the interpolation unit 25 shown in FIG. 3.

Since the characteristics of the phase retrieved from the $\tan^{-1}$ processor 24 via terminal 27 are defined in a domain of $2\pi$ of from $-\pi$ to $+\pi$, as shown in FIG. 7, the phase value lower than $-\pi$ is overlapped towards the $+\pi$ side oe wrapped thus representing a discontinuous portion in FIG. 7. Since this discontinuous portion cannot be differentiated, it is converted into a continuous portion by phase unwrapping processing by the phase unwrap unit 25*a* of FIG. 20. The unwrapped phase state is shown as an example in FIG. 21.

Figure 22:
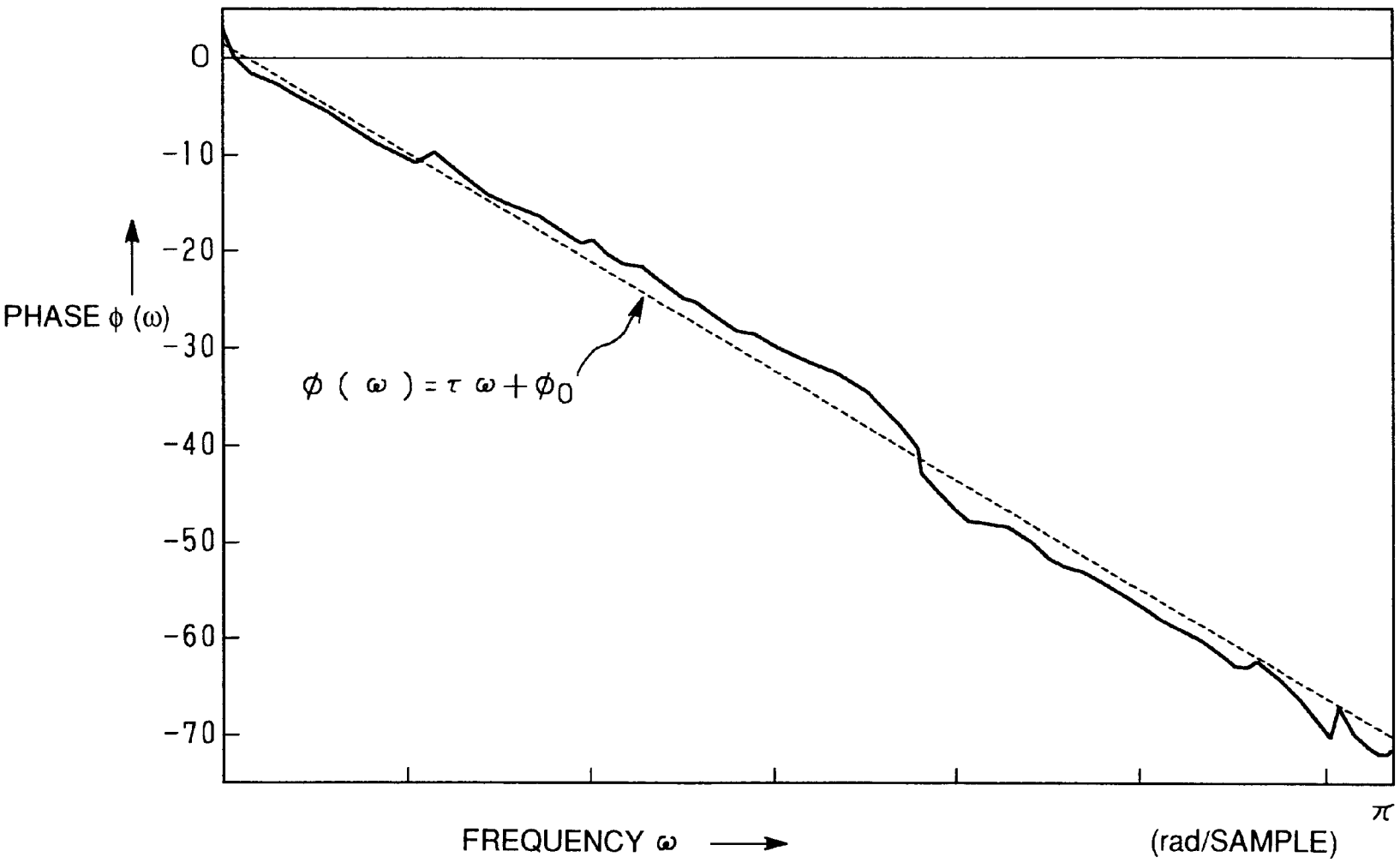
FIG. 22 shows an example of phase approximation phase characteristics obtained on least square phase characteristics.

From the 2N−1 point unwrap phase $\phi(\omega_i)$, obtained from the phase unwrap unit 25*a* and the spectral amplitude weighting $wt(\omega_i)$, that is from $$\omega_i=i\pi/(2^{N-1}) \quad (23)$$

$$\phi_i=\phi(\omega_i) \quad (24)$$

$$wt_i=wt(\omega_i) \quad (25),$$

the linear approximated phase:

$$\phi(\omega)=-\tau\omega+\phi_0 \quad (26)$$

as indicated by a broken line in FIG. 22 is found by the weighting least square method. That is, $\tau$ and $\phi 0$ which will minimize the following equation (27):

$$\varepsilon(\tau, \phi_0) = \sum_{i=1}^{M} wt_i|\phi_i + \tau\omega_i - \phi_0|^2 \quad (27)$$

is found.

$$\frac{d\varepsilon}{d\tau} = -2\sum_{i=1}^{M} wt_i\omega_i\phi_i - 2\tau\sum_{i=1}^{M} wt_i\omega_i^2 + 2\phi_0\sum_{i=1}^{M} wt_i\omega_i \quad (28)$$

$$\frac{d\varepsilon}{d\phi_0} = -2\sum_{i=1}^{M} wt_i\phi_i - 2\tau\sum_{i=1}^{M} wt_i\omega_i + 2\phi_0\sum_{i=1}^{M} wt_i \quad (29)$$

It is noted that $\tau$ and $\phi_0$, for which the equations (28) and (29) are zero, that is for which $d\epsilon/d\tau=0$ and $d\epsilon/d\phi_0=0$, can be found by the following equations (30) and (31):

$$\tau = \frac{EB - CD}{AD - B^2} \quad (30)$$

$$\phi 0 = \frac{AE - BC}{AD - B^2} \quad (31)$$

where $$A = \sum_{i=1}^{M} wt_i\omega_i'^2 \quad (32)$$

$$B = \sum_{i=1}^{M} wt_i\omega_i \quad (33)$$

$$C = \sum_{i=1}^{M} wt_i\omega_i\phi_i \quad (34)$$

$$D = \sum_{i=1}^{M} wt_i \quad (35)$$

$$E = \sum_{i=1}^{M} wt_i\phi_i. \quad (36)$$

Figure 23:
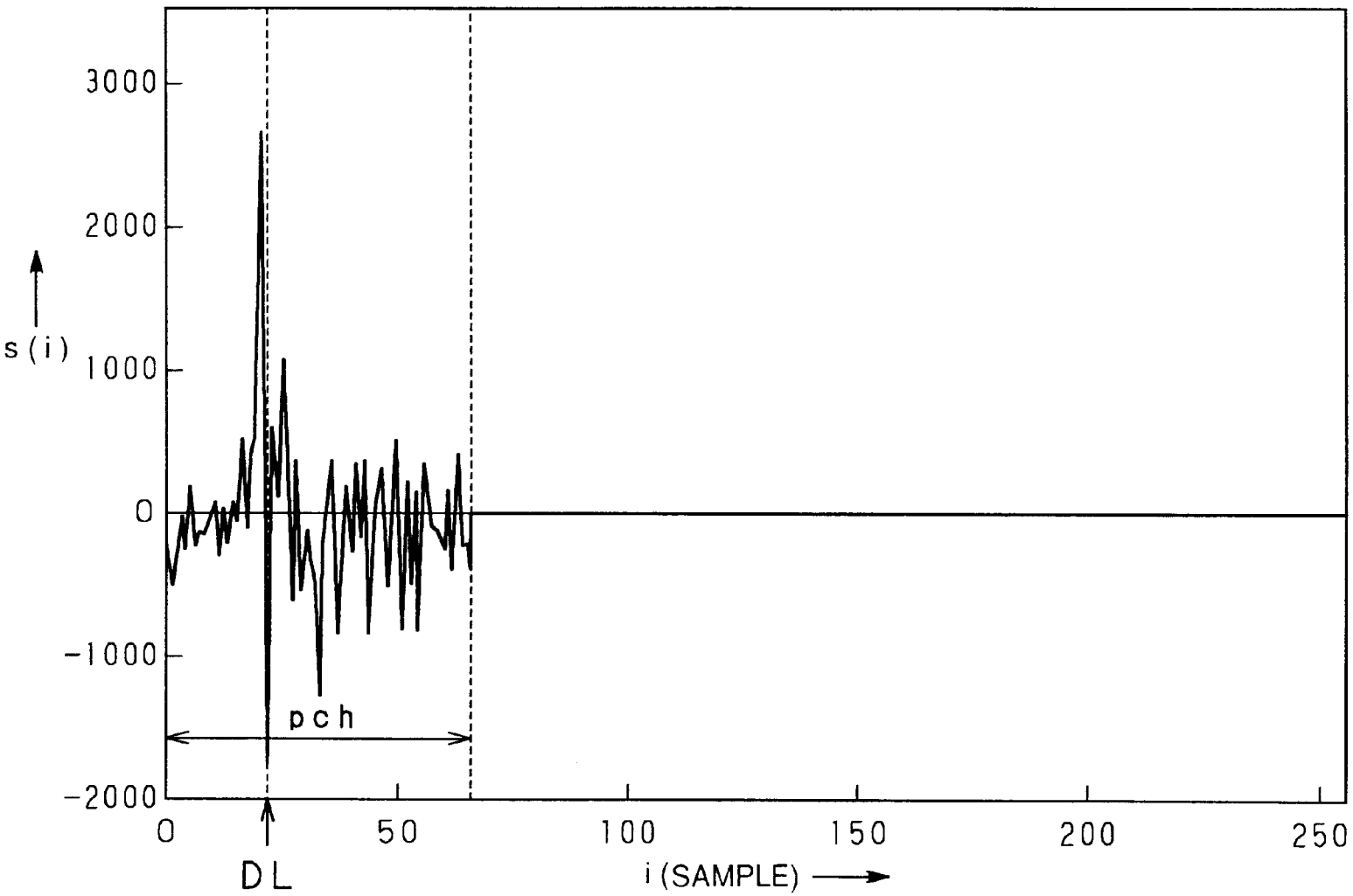
FIG. 23 shows typical delay as found from the linear approximation phase characteristics.

It is noted that thus found serves as the number of delay samples. The number of delayed samples $\tau$ of the detected delay quantity DL of one pitch waveform shown in FIG. 23 is e.g., 22.9 samples.

Figure 21:
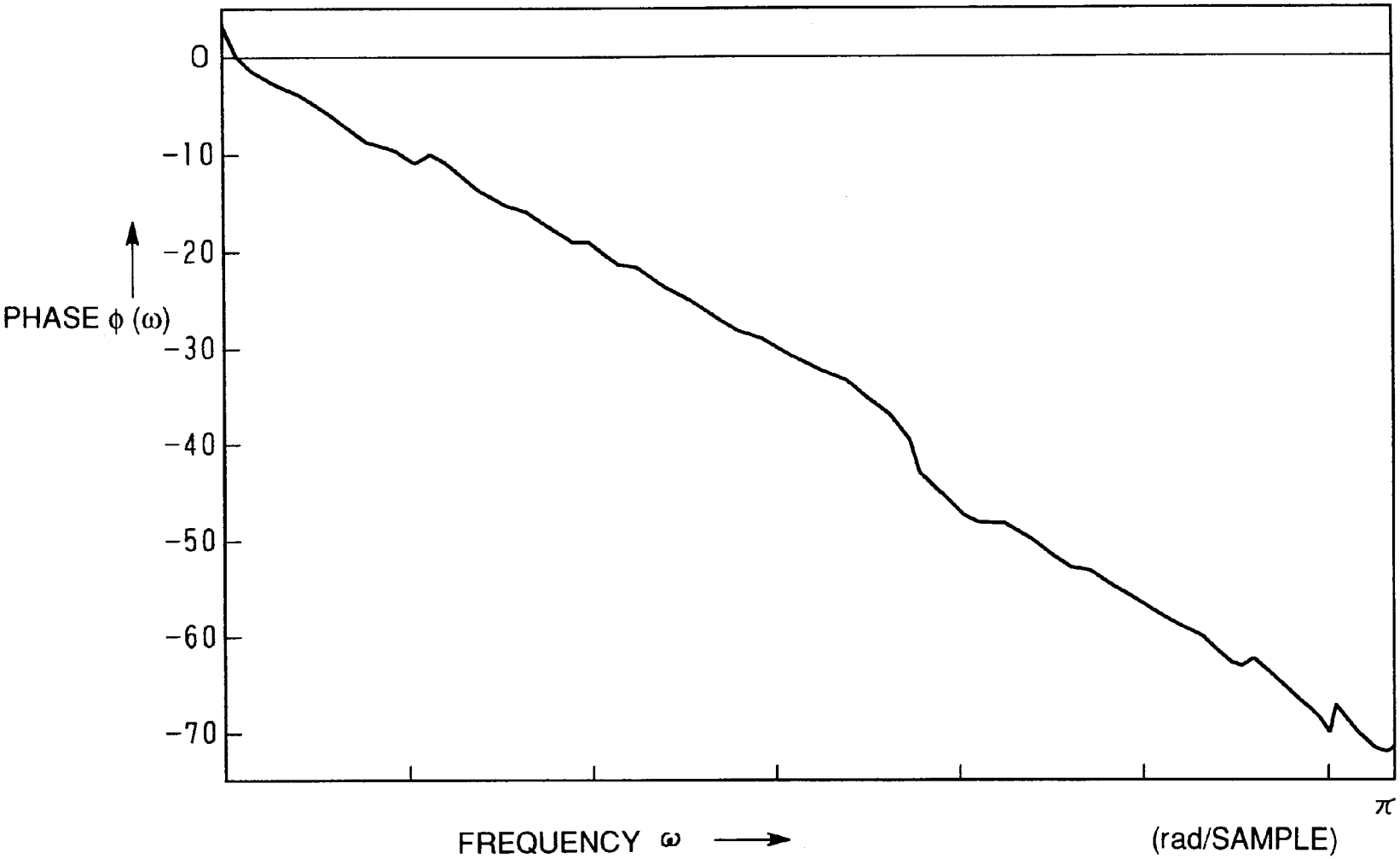
FIG. 21 shows an example of the unwrapped phase.
Figure 24:
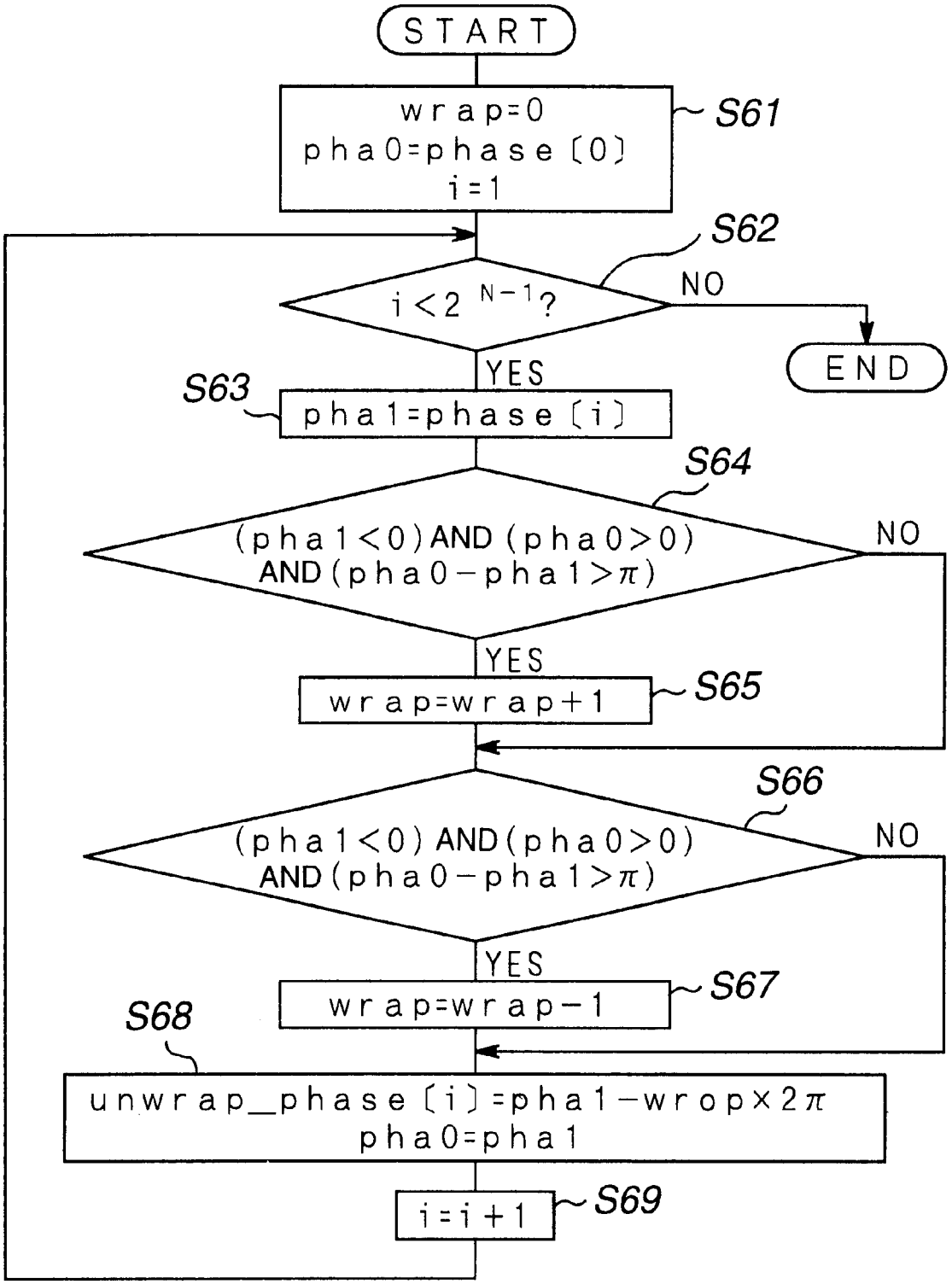
FIG. 24 is a flowchart showing an example of phase unwrapping.

FIG. 24 shows a flowchart of a specified example of the phase unwrap processing described above. In this figure, "phase" at steps S61 and S63 represent pre-unwrap phase, while unwrap_phase at step S68 represents the unwrapped phase. At step S61, variables "wrap" specifying the number of wraps, the variable pha0 for transiently retriving the phase and the variable "i" representing the sample number, are initialized to 0, phase(0) and to 1, respectively. The processing of detecting the phase discontinuity and sequentially subtracting $2\pi$ to maintain phase continuity is carried out repeatedly until i reaches $2^{N-1}$ at steps S62 to S69. By this unwrap processing, the phase of FIG. 7 is converted to a continuous one as shown in FIG. 21.

In the above-described weighted least square linear approximation, the case of using the spectral amplitude weight and the unwrap phase only of the harmonics components is explained.

Since the pitch lag pch is known, the fundamental frequency (angular frequency) $\omega 0$ is $$\omega 0=2\pi/pch \quad (37).$$

In a range of from $\omega=0$ to $\omega=\pi$ on the frequency axis, M harmonics are arrayed at an interval of $\omega 0$. This M is expressed as M=pch/2. From the $2^{N-1}$ point unwrap phase $\phi(\omega i)$, as found by the unwrap processing, and spectral amplitude weight ($\omega i$), the unwrap phase in each harmonics and the spectral weight are found by:

$$\omega_i=\omega_0\times i(i=1, 2, \ldots, M) \quad (38)$$

$$\phi_i=\phi(\omega_i) \quad (39)$$

$$wt_i=wt(\omega_i) \quad (40).$$

Using only the information on the harmonics components, the weighted least square linear approximation is carried out in a manner as described above to find the linear approximated phase.

Next, in the above-described weighted least square linear approximation, the case of using the spectral amplitude weighting in the low to mid range of the speech signals and the unwrap phase is explained.

Specifically, considering that the phase information detected at a higher range is not that reliable, weighted least square linear approximation is carried out, using only the unwrap phase of the point of $$0\leqq\omega_i\leqq\beta\times\pi \quad (41)$$

and the spectral amplitude weight $wt(\omega_i)$, by a real constant $\beta$ ($0<\beta<1$) for taking out the low range, in order to find the linear phase approximation.

The number of points M for processing is given by the equations (42) or (43):

$$M=\lfloor\beta\times 2^{N-1}\rfloor \quad (42)$$

$$M=\left\lceil\beta\times\frac{pch}{2}\right\rceil \quad (43)$$

where the equation (43) indicates the case of processing at the respective harmonics points. In the above equations, $\lfloor x\rfloor$ is a maximum integer not exceeding x and is also represented as :floor(x), while $\lceil x\rceil$ is a minimum integer larger than x and is also represented as ceil(x).

Figure 25:
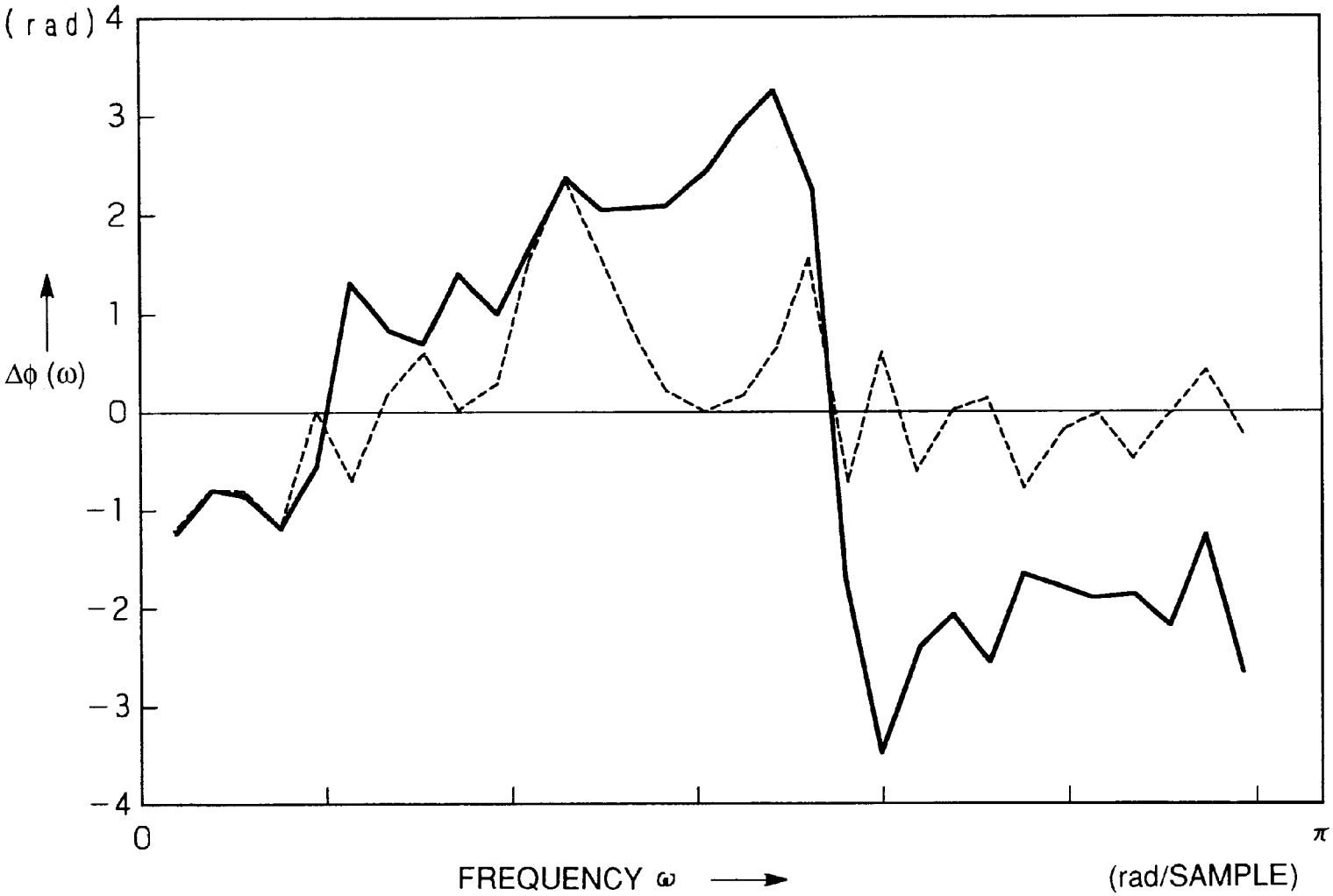
FIG. 25 shows a fine phase structure and a quantized fine structure.

By the above-described delay detection, delay components of periodic signals, such as speech signals, at a certain time point, can be accurately and efficiently processed by the phase unwrapping and by spectrum weighted least square linear approximation. The initially obtained unwrap phase characteristics less the linear phase characteristics obtained by the weighted least square linear approximation represents a fine phase structure. That is, the fine phase structure $\Delta\phi(\omega)$ is given by $$\Delta\phi(\omega)=\phi(\omega)+\tau\omega-\phi_0 \quad (44)$$

from the unwrap phase $\phi(\omega)$ and the linear approximated phase characteristics $\tau\omega+\phi 0$. An example of the fine phase components $\Delta\phi(\omega)$ is shown by a solid line in FIG. 25.

Meanwhile, in the example of FIG. 19, the tilt $\tau$ and the intercept $\phi_0$ as the components of the linear phase approximation are sent via terminal 27 to a scalar quantizer 37 for scalar quantization. The quantized tilt $Q(\tau)$ and the intercept $Q(\phi 0)$ are taken out at an output terminal 38. Also, the quantized flt $Q(\tau)$ and the intercept $Q(\phi 0)$ are subtracted from the detected unwrap phase $\phi_i$ to find the difference $\Delta\phi_i$ by $$\Delta\phi_i=\phi_i+Q(\tau)i\omega_0-Q(\phi_0), \text{ where } 1\leqq i\leqq M \quad (45).$$

As explained with reference to FIGS. 2 and 16, the optimum number of assigned quantization bits $ba_i$ is found on the harmonics basis, in keeping with the spectral amplitudes of the speech signals, by the weighting calculation unit 18 and the bit allocation calculation unit 19, and the above difference $\Delta\phi_i$ is scalar-quantized by the scalar quantizer 13 in keeping with the number of assigned quantization bits $ba_i$. If the number of assigned quantization bits is 0, $\Delta\phi_i$ is set to 0 or a random number near 0. An example of this quantization is indicated by a broken line in FIG. 25.

If the quantized $\Delta\phi_i$ is $Q(\Delta\phi_i)$, the quantized phase $Q(\phi_i)$ of the ith harmonics is expressed by $$Q(\phi_i)=Q(\Delta\phi_i)-Q(\tau)i\omega_0-Q(\phi_0), \text{ where } 1\leqq i\leqq M \quad (46).$$

As a modification, it may be contemplated to back-calculate the intercept of linear approximation from the phase of the harmonics components with the maximum weighting coefficient.

In this case, only the tilt $\tau$ of the approximated linear phase component from the terminal 27 of FIG. 19 is quantized, while the intercept $\phi_0$ is not quantized. Then, with the index j of the harmonics with the maximum spectral amplitude $wt_i$, where $1\leqq i\leqq M$, $$\Delta\phi_j=\phi_j+Q(\tau)j\omega_0-Q(\phi_0) \quad (47)$$

is scalar quantized with the number of assigned quantization bits $ba_j$. Then, with the quantized $\Delta\phi_j$ set to Q $\Delta\phi_j$, the intercept of the linear phase component is bac1-calculated by $$\Delta\phi_0=\phi_j-Q(\tau)j\omega_0-Q(\phi_j) \quad (48).$$

By this processing, it becomes unnecessary to quantize the intercept $\phi_0$ of the linear phase component. The ensuing operation is the same as that discussed previously.

Figure 26:
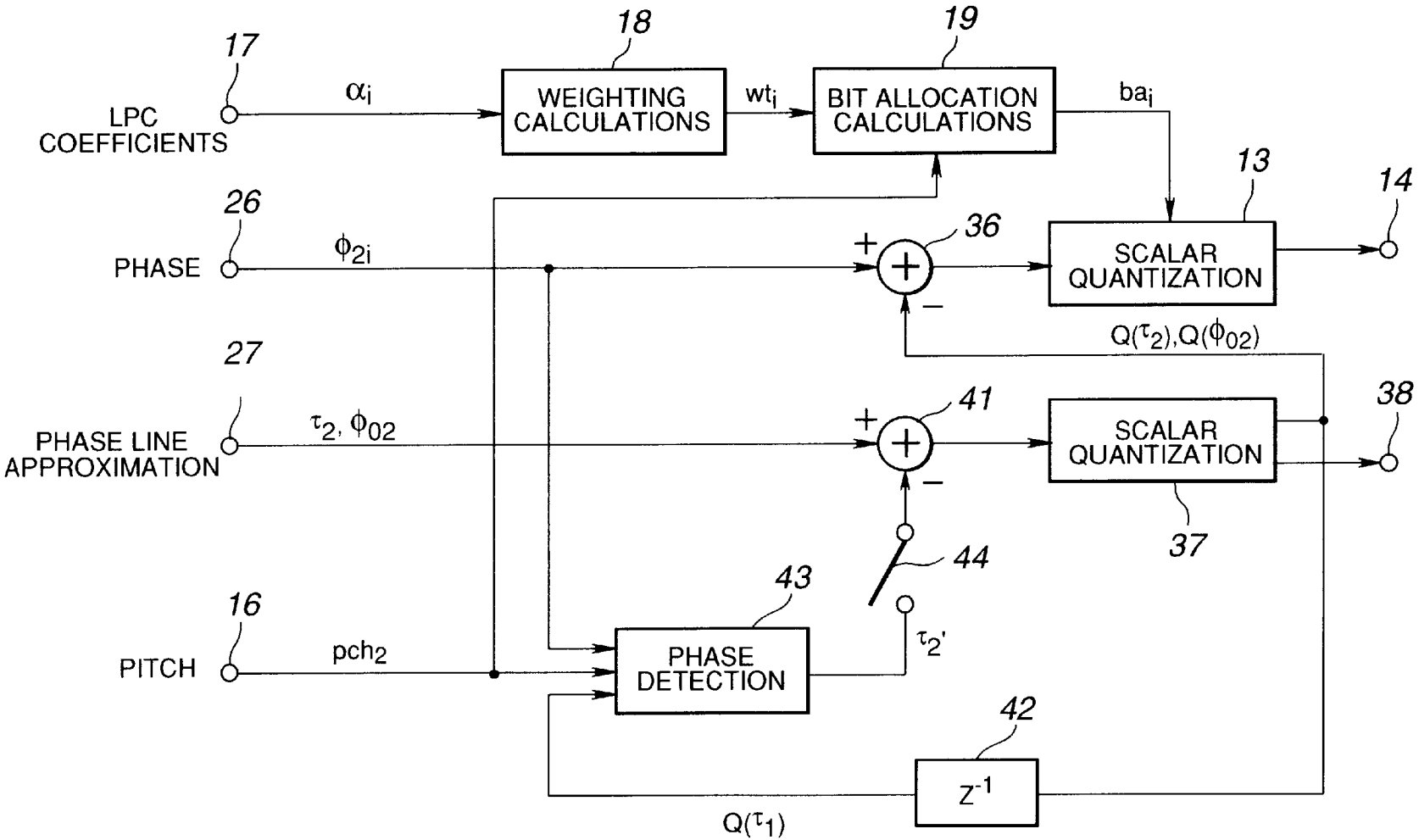
FIG. 26 is a schematic block diagram showing a structure of a phase quantization device according to a further embodiment of the present invention.

Referring to FIG. 26, a further modification is explained. In the present embodiment, if the tilt of the pitch frequency drift from the previous frame is within a pre-set range, the tilt of the linear approximation of the current frame is predicted from the pitch lag of the current frame and the results of quantization of the tilt of the linear approximation of the previous frame to scalar quantize the prediction error.

In FIG. 26, parts or components corresponding to those of FIG. 19 are depicted by the same reference numerals. In the following explanation, only different or added portions are mainly explained. The suffices 1 and 2 to the phase $\phi$ and to the pitch pch denote the previous and current frames, respectively.

The linear phase approximation component from the terminal 27 is sent via the subtractor 41 to the scalar quantizer 37. The quantized linear phase approximation component from the scalar quantizer 37 is sent to the subtractor 36, while being sent via the one-frame delay unit 42 to a delay prediction unit 43, to which are sent the pitch from the terminal 16 and the phase from the terminal 26.

In the configuration of FIG. 26, the weighting calculation unit 18 and the bit allocation calculation unit 19 calculate the number of assigned quantization bits $ba_i$, using the quantization LPC coefficients, as in the embodiment of FIG. 2. If the pitch frequency drift, shown by the following equation (49):

$$\left|\frac{\omega_{02}-\omega_{01}}{\omega_{02}}\right| \quad (49)$$

is outside a pre-set range, that is if the pitch is discontinuous, phase quantization similar to that explained with reference to FIG. 19 is carried out.

If, conversely, the pitch frequency drift shown by the above equation (49) is within a pre-set range, that is if the pitch is continuous, the delay prediction unit 43 calculated the following equation (50):

$$\tau_2' = Q(\tau_1) + \frac{pch_1 + pch_2}{2} \times K - L \tag{50}$$

is found from the quantized delay component $Q(\tau_1)$ of the previous frame, pitch lag pch1 of the previous frame and the pitch lag pch2 of the current frame to predict the delay component $\tau_2'$ of the current frame. In the equation (50), K and L denote a proper positive constant and a frame interval, respectively.

Figure 27:
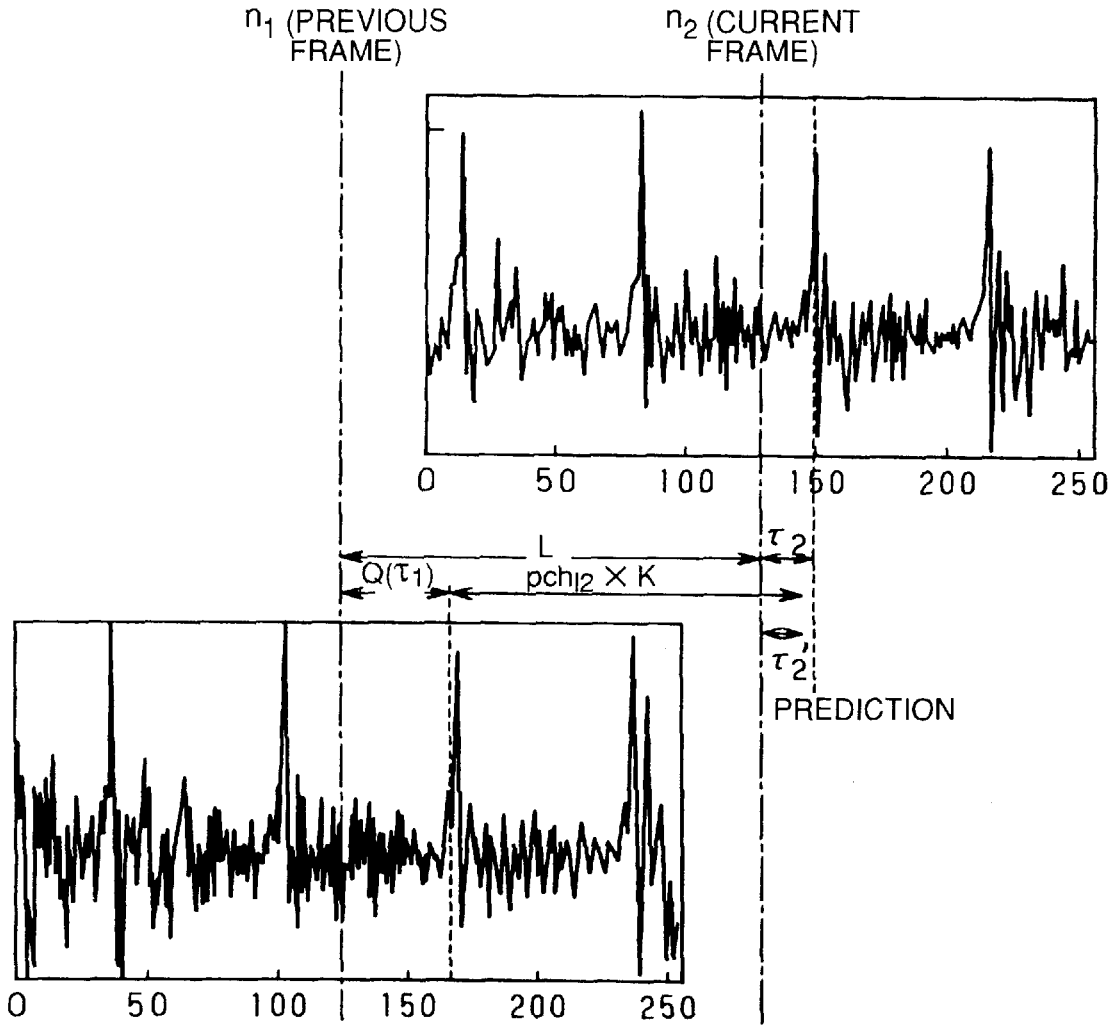
FIG. 27 illustrates prediction processing of fixed phase delay components.

FIG. 27 shows a signal waveform diagram showing an example of prediction of delay components by the equation (50). That is, with the center position $n_1$ of the previous frame as a reference, the mean pitch lag (pch1+pch2)/2 multiplied by K is summed to the quantized delay component $q(\tau_1)$ and the interval L between the previous frame and the current frame is subtracted from the result of addition to give a prediction delay component $\tau_2'$.

Then, a difference $\Delta\tau_2$ between the detected delay component $\tau_2$ and the predicted delay component $\tau_2'$ $$\Delta\tau_2=\tau_2-\tau_2' \tag{51}$$

is found by the subtractor 41 and scalar-quantized by the scalar quantizer 37.

Figure 11:
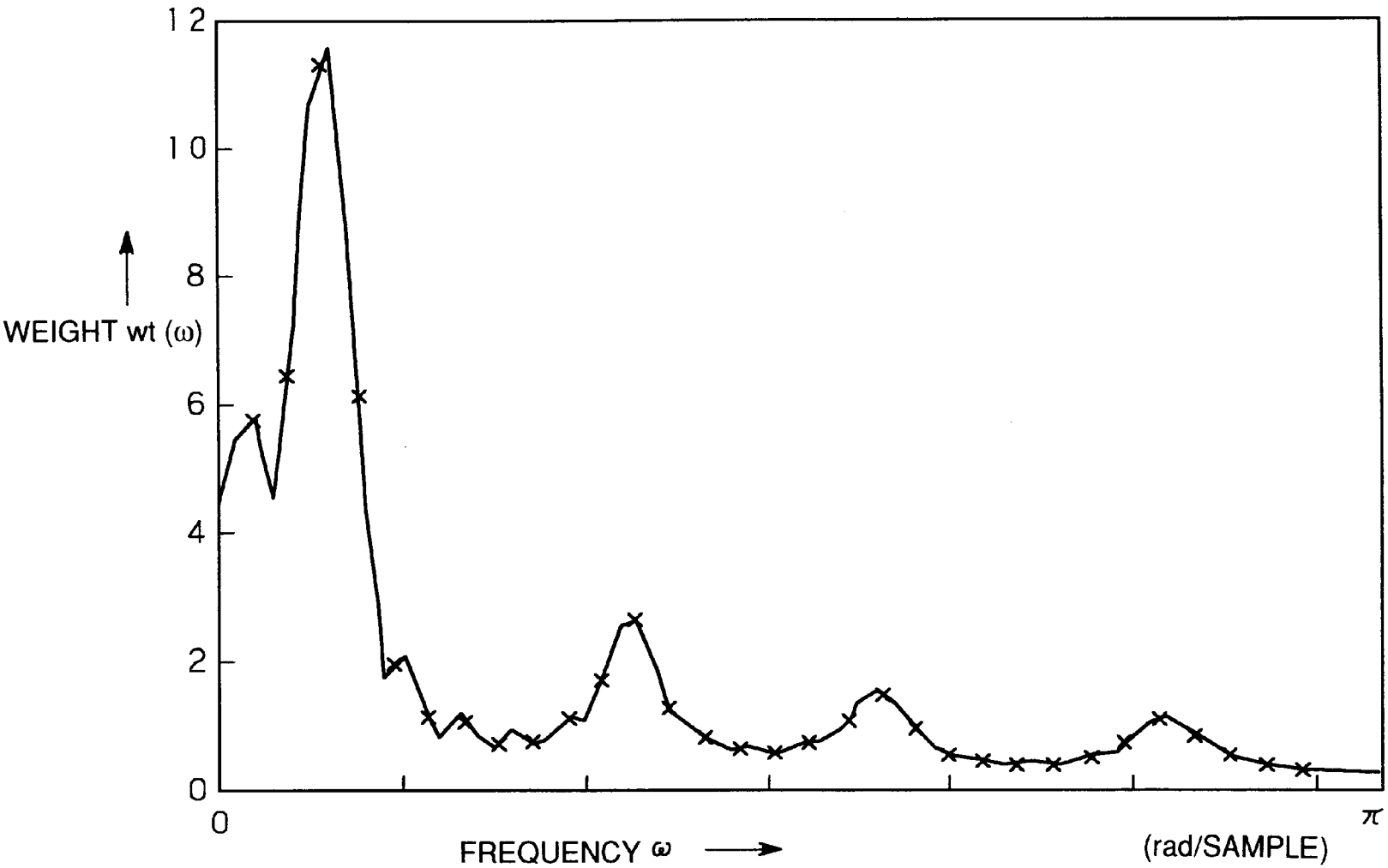
FIG. 11 shows an example of spectral amplitude characteristics calculated from the LPC of speech signals.

With the quantized $\Delta\tau_2$ set to $Q(\Delta\tau_2)$, the quantized delay component $Q(\tau_2)$ is set to $$Q(\tau_2)=\tau_2'+Q(\Delta\tau_2) \tag{52}$$

and processing similar to that in the embodiment of FIG. 11 is subsequently performed.

In the above phase quantization, equivalent results can be realized by assigning the number of quantization bits smaller than that in the case of the "pitch discontinuous" case, at the time of quantization of the detected delay component $\tau_2$. In the "pitch continuous" case, the saved number of the assigned quantization bits for the delay component can be effectively transferred to the bit assignment of phase quantization.

The phase detection can be performed for speech signals or linear prediction residual (LPC residual) signals of the speech signals, as discussed previously.

Figure 28:
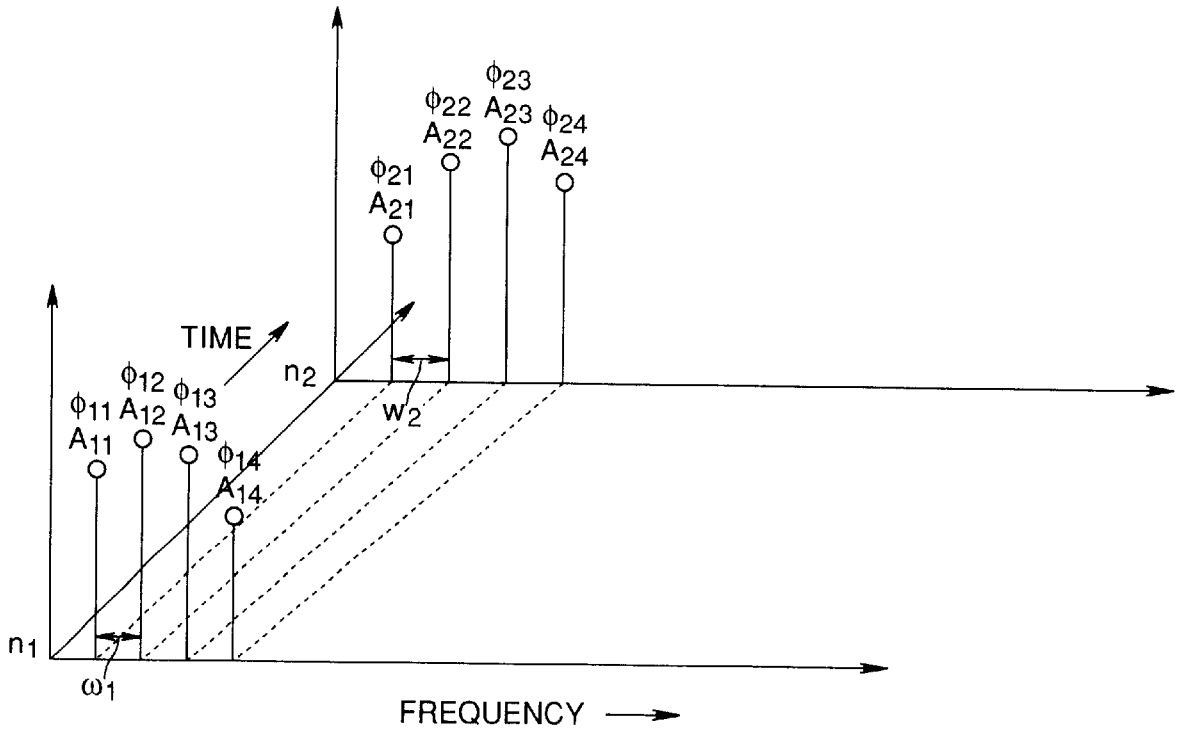
FIG. 28 shows an example of sine wave synthesis in case the phase information is obtained.

The case of effecting sine wave synthesis using the phase information obtained as described above is explained with reference to FIG. 28. It is assumed here that the time waveform of a frame interval $L=n_2-n_1$ since time $n_1$ until time $n_2$ is reproduced by sine wave synthesis (sinusoidal synthesis).

If the pitch lag at time $n_1$ is $pch_1$ (sample) and that of time $n_2$ is $pch_2$ (sample), the pitch frequencies $\omega_1$, $\omega_2$ (rad/sample) at time $n_1$ and at time $n_2$ are given by $$\omega_1=2\pi/pch_1$$

$$\omega_2=2\pi/pch_2$$

respectively. Also, it is assumed that the amplitude data of the respective harmonics are $A_{11}, A_{12}, A_{13}, \ldots$ at time $n_1$ and $A_{21}, A_{22}, A_{23}, \ldots$ at time $n_2$, while phase data of the respective harmonics at time $n_1$ are $\phi_{11}, \phi_{12}, \phi_{13}, \ldots$ at time n1 and $\phi_{21}, \phi_{22}, \phi_{23}, \ldots$ at time $n_2$.

If the pitch is continuous, the amplitude of the mth harmonics at time n ($n_1 \leqq n \leqq n_2$) is obtained by linear interpolation of amplitude data at time points $n_1$ and $n_2$ by the following equation (53):

$$A_m n = \frac{n_2 - n}{L} A_{im} + \frac{n - n_1}{L} A_{2m} \text{ where } n_1 \le n \le n_2. \tag{53}$$

It is assumed that the frequency change of the mth harmonics component between time $n_1$ and time $n_2$ is (linear change component)+(fixed variation), as indicated by the following equation (54):

$$\omega_m(n) = m\omega_1 n_2 - \frac{n}{L} + m\omega_2 n - \frac{n_1}{L} + \Delta\omega_m \text{ where } n_1 \le n \le n_2. \tag{54}$$

Since the phase $\theta_m(n)$(rad) at time n of the mth harmonics is expressed by the following equation (55):

$$\theta_m(n) = \int_{n_1}^{n} \omega_m(\xi)\, d\xi + \phi_{1m}. \tag{55}$$

$$= \int_{n_1}^{n} \left(m\omega_1 n_2 - \frac{\xi}{L} + m\omega_2 \xi - \frac{n_1}{L} + \Delta\omega_m\right) d\xi + \phi_{1m}. \tag{56}$$

$$= m\omega_1(n - n_1) + m(\omega_2 - \omega_1)\frac{(n - n_1)^2}{2L} + \Delta\omega_m L + \phi_{1m}. \tag{57}$$

Therefore, the phase $\phi_{2m}$(rad) of the mth harmonics at time $n_2$ is given by the following equation (59), so that a variation $\Delta\omega_m$ of the frequency change of the respective harmonics (read/sample) is as shown by the following equation (60):

$$\phi_{2m} = \theta_m(n2). \tag{58}$$

$$= \frac{m(\omega_1 + \omega_2)L}{2} + \Delta\omega_m L + \phi_{1m}. \tag{59}$$

$$\Delta\omega_m = \frac{\phi_{1m} - \phi_{2m}}{L} - \frac{m(\omega_1 + \omega_2)}{2}. \tag{60}$$

As for the mth harmonics, since the phase $\phi_{im}$, $\phi_{2m}$ at time points $n_1$ and $n_2$ are accorded, the time waveform Wm(n) by the mth harmonics is given by $$W_m(n)=A_m(n)\cos(\theta_m(n)) \tag{61}$$

where $n_1 \leqq n \leqq n_2$.

The sum of time waveforms on the totality of harmonics, obtained in this manner, represent synthesized waveform V(n), as indicated by the following equations (62), (63):

$$V(n) = \sum_m W_m(n) \tag{62}$$

$$= \sum_m A_m(n)\cos(\theta_m(n)). \tag{63}$$

The case of discontinuous pitch is now explained. If the pitch is discontinuous, in this case, the waveform $V_1(n)$, shown by the following equation (64):

$$V_1(n) = \sum_m A_{im}\cos(m\omega_1(n - n_1) + \phi_{im} \tag{64}$$

obtained on sinusoidal synthesis forwardly of time $n_1$ and the waveform $V_2(n)$ shown by the following equation (65):

$$V_2(n) = \sum_m A_{2m}\cos(-m\omega_2(n_2 - n) + \phi_{2m}) \quad (65)$$

obtained on sinusoidal synthesis backwardly of time $n_2$ are respectively windowed and overlap-added, without taking frequency change continuity into consideration.

With the above-described phase quantization device, instantaneous phase information of the input speech signal or its short-term prediction residual signals can be quantized efficiently. Thus, in the speech encoding by sinusoidal synthesis encoding of the input speech signal or its short-term prediction residual signals, reproducibility of the original waveform on decoding can be realized by quantizing and transmitting the instantaneous phase information.

Figure 29:
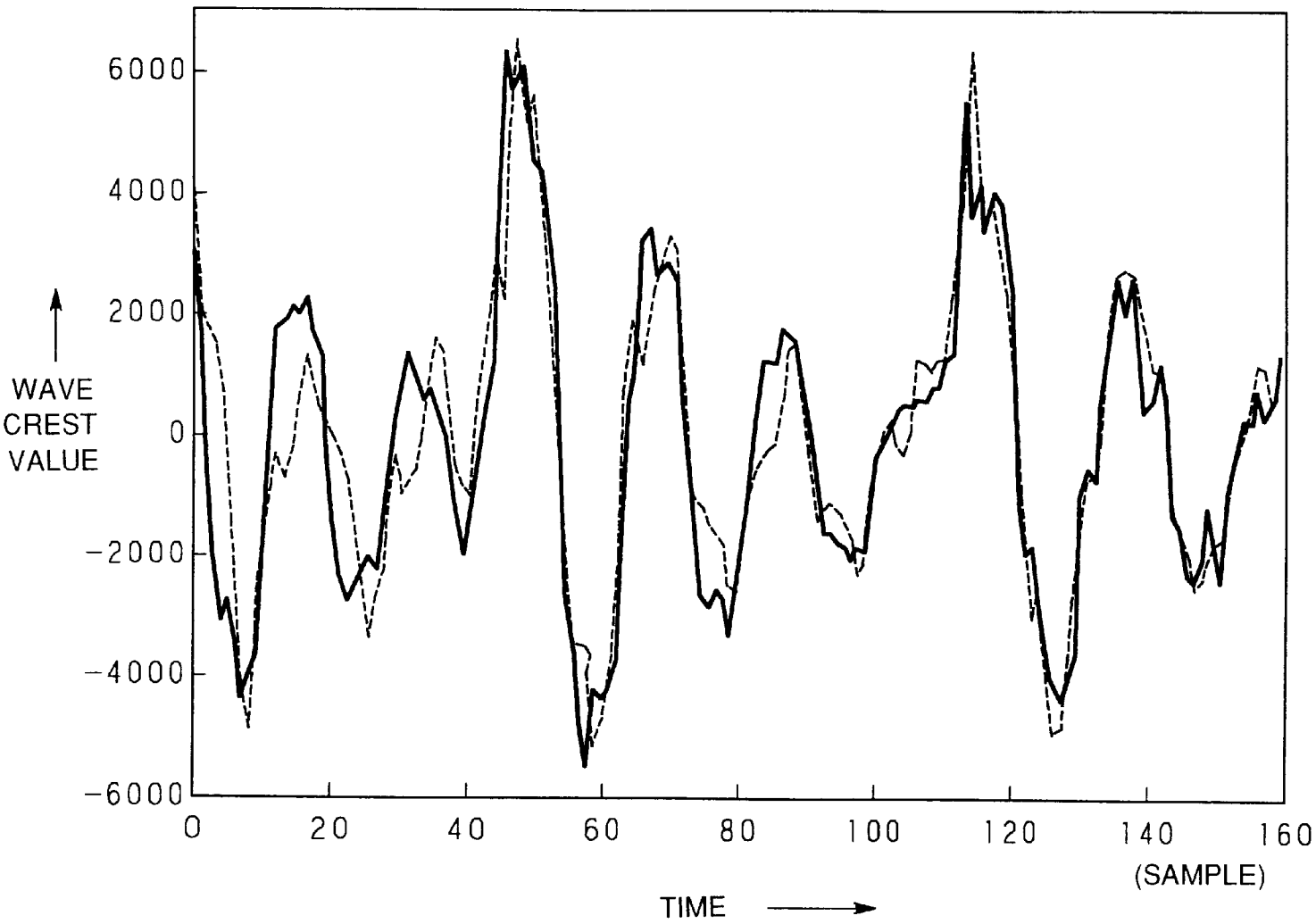
FIG. 29 shows an example of signal waveform obtained on sine wave synthesis on the decoder side in case the phase information is obtained.

As may be seen from FIG. 29, showing the original signal waveform by a solid line and also showing the signal waveform obtained on decoding the phase-quantized and transmitted original signal waveform by a broken line, the original signal waveform can be reproduced with high reproducibility.

The present invention is not limited to the above-described embodiments. For example, although the respective parts of the configuration of FIGS. 1 and 2 are depicted as hardware, it is also possible to realize the configuration by a software program using a so-called digital signal processor (DSP).

What is claimed is:

1. A phase quantization apparatus comprising:

assignment bit number calculating means for calculating an optimum number of quantization bits assigned to respective harmonics of input speech signals; and quantization means for quantizing a phase of the respective harmonics of signals derived from the input speech signals in accordance with the assigned number of bits calculated by the assignment bit number calculating means.

2. The phase quantization apparatus according to claim 1, wherein the signals derived from the input speech signals are speech signals.

3. The phase quantization apparatus according to claim 1, wherein the signals derived from the input speech signals are signal waveforms of short-term prediction residual signals of speech signals.

4. The phase quantization apparatus according to claim 1, wherein the assignment bit number calculating means calculates the optimum number of quantization bits assigned to the respective harmonics using short-term prediction residual signals of the input speech signals.

5. The phase quantization apparatus according to claim 1, further comprising:

phase prediction means for performing a quantization for each frame of a pre-set length on a time axis to predict the phase of the respective harmonics of a current frame of the signals derived from the input speech signals from the results of phase quantization of a previous frame; and said quantization means quantizes a prediction error between the phase of the respective harmonics of the current frame and a predicted phase found by the phase prediction means depending on a number of assigned bits calculated by the assignment bit number calculating means.

6. The phase quantization apparatus according to claim 5, wherein the prediction error between the predicted error and the phase of the current frame is quantized only when the drift of a pitch frequency of the speech signals from the previous frame up to the current frame is within a pre-set range.

7. A phase quantization method comprising:

an assignment bit number calculating step of calculating an optimum number of quantization bits assigned to respective harmonics of input speech signals; and a quantization step of quantizing a phase of the respective harmonics of signals derived from the input speech signals in accordance with the assigned number of bits calculated by the assignment bit number calculating step.

8. The phase quantization method according to claim 7, wherein the assignment bit number calculating step calculates the optimum number of quantization bits assigned to the respective harmonics using short-term prediction coefficients of the input speech signals.

9. The phase quantization method according to claim 7, further comprising:

a phase prediction step of performing a quantization for each frame of a pre-set length on a time axis to predict the phase of the respective harmonics of a current frame of signals derived from the input speech signals from the results of phase quantization of a previous frame; and said quantization step quantizes a prediction error between the phase of the respective harmonics of the current frame and a predicted phase found by the phase prediction step depending on a number of assigned bits calculated by the assignment bit number calculating step when the drift of a pitch frequency of the speech signals from the previous frame to the current frame is in a pre-set range.

10. A phase quantization apparatus comprising:

assignment bit number calculating means for calculating an optimum number of quantization bits assigned to respective harmonics of input speech signals; and quantization means for quantizing a difference between an approximated phase of respective harmonics components as found from an approximation line of unwrapped phase characteristics for a phase of the respective harmonics components of signals derived from the input speech signals and the phase of the respective harmonics components of the signals derived from the input speech signals depending on the optimum number of assigned bits calculated by the assignment bit number calculating means.

11. The phase quantization apparatus according to claim 10, wherein the signals derived from the input speech signals are speech signals.

12. The phase quantization apparatus according to claim 10, wherein the signals derived from the input speech signals are signal waveforms of short-term prediction residual signals of speech signals.

13. The phase quantization apparatus according to claim 10, wherein the assignment bit number calculating means calculates the optimum number of quantization bits assigned to the respective harmonics using short-term prediction residual signals of the input speech signals.

14. The phase quantization apparatus according to claim 10, wherein the approximation line is found by performing least square line approximation weighted by spectral amplitude of the input speech signals on the unwrapped phase characteristics.

15. The phase quantization apparatus according to claim 14, wherein an intercept of the approximation line is found by back-calculations from a phase of a harmonic component having a maximum weighting coefficient.

16. The phase quantization apparatus according to claim 14, wherein the approximate phase is found from a phase of the approximation line by a tilt and an intercept obtained on quantizing the tilt and the intercept of the approximation line.

17. The phase quantization apparatus according to claim 10 further comprising:

tilt prediction means for performing a quantization for each frame of a pre-set length on a time axis and for predicting a tilt of the approximation line of a current frame of the signals derived from the input speech signals from the results of quantization of the tilt of the approximation line of a previous frame and from a pitch lag of the current frame; and said quantization means quantizes a predicted error of said tilt.

18. A phase quantization method comprising:

an assignment bit number calculating step of calculating an optimum number of quantization bits assigned to respective harmonics of input speech signals; and a quantization step of quantizing a difference between an approximated phase of respective harmonics components as found from an approximation line of unwrapped phase characteristics for a phase of respective harmonics components of signals derived from the input speech signals and the phase of the respective harmonics components of the signals derived from the input speech signals depending on the optimum number of assigned bits calculated by the assignment bit number calculating step.

19. The phase quantization method according to claim 18, wherein the assignment bit number calculating step calculates the optimum number of assigned bits to the respective harmonics components using short-term prediction coefficients of the input speech signals.

20. The phase quantization method according to claim 18, wherein the approximation line is found by performing least square line approximation weighted by spectral amplitude of the input speech signals on the unwrapped phase characteristics.

* * * * *